US011121477B2

(12) United States Patent
Han et al.

(10) Patent No.: US 11,121,477 B2
(45) Date of Patent: Sep. 14, 2021

(54) ANTENNA APPARATUS

(71) Applicants: Samsung Electro-Mechanics Co., Ltd., Suwon-si (KR); Research & Business Foundation Sungkyunkwan University, Suwon-si (KR)

(72) Inventors: Myeong Woo Han, Suwon-si (KR); Dae Ki Lim, Suwon-si (KR); Yong Serk Kim, Suwon-si (KR); Keum Cheol Hwang, Suwon-si (KR); Nam Heung Kim, Suwon-si (KR); Won Cheol Lee, Suwon-si (KR); Young Sik Hur, Suwon-si (KR)

(73) Assignees: SAMSUNG ELECTRO-MECHANICS CO., LTD., Suwon-si (KR); RESEARCH & BUSINESS FOUNDATION SUNGKYUNKWAN UNIVERSITY, Suwon-si (KR)

( * ) Notice: Subject to any disclaimer, the term of this patent is extended or adjusted under 35 U.S.C. 154(b) by 0 days.

(21) Appl. No.: 16/801,581

(22) Filed: Feb. 26, 2020

(65) Prior Publication Data

US 2021/0151898 A1 May 20, 2021

(30) Foreign Application Priority Data

Nov. 20, 2019 (KR) ..... 10-2019-0149283

(51) Int. Cl.

| | |
|---|---|
| ***H01Q 21/06*** | (2006.01) |
| ***H01Q 9/04*** | (2006.01) |
| ***H01Q 1/48*** | (2006.01) |

(52) U.S. Cl.
CPC ..... *H01Q 21/065* (2013.01); *H01Q 1/48* (2013.01); *H01Q 9/0457* (2013.01)

(58) Field of Classification Search
CPC ..... H01Q 21/065; H01Q 9/0457; H01Q 1/48
See application file for complete search history.

(56) References Cited

U.S. PATENT DOCUMENTS

| | | | | |
|---|---|---|---|---|
| 2021/0005982 | A1* | 1/2021 | Han | H01Q 19/005 |
| 2021/0044028 | A1* | 2/2021 | Lee | H01Q 9/045 |
| 2021/0075114 | A1* | 3/2021 | Kim | H01Q 21/28 |

FOREIGN PATENT DOCUMENTS

| | | | |
|---|---|---|---|
| JP | 2002-344238 | A | 11/2002 |
| JP | 3699408 | B2 | 9/2005 |
| KR | 10-1829816 | B1 | 2/2018 |

* cited by examiner

*Primary Examiner* — Daniel D Chang
(74) *Attorney, Agent, or Firm* — NSIP Law

(57) ABSTRACT

An antenna apparatus includes a ground plane; first and second patch antenna patterns disposed above and spaced apart from the ground plane, and spaced apart from each other; a first feed via providing a first feed path of the first patch antenna pattern through a first point disposed adjacent to an edge of the first patch antenna pattern in a direction spaced apart from the second patch antenna pattern; a second feed via providing a second feed path of the second patch antenna pattern through a second point disposed adjacent to an edge of the second patch antenna pattern in a direction spaced apart from the first patch antenna pattern; and a first coupling pattern spaced apart from the first and second patch antenna patterns between the first and second patch antenna patterns, and defining a first internal space exposed towards the first patch antenna pattern.

17 Claims, 19 Drawing Sheets

ANTENNA APPARATUS

CROSS-REFERENCE TO RELATED APPLICATION(S)

This application claims the benefit under 35 USC § 119(a) of Korean Patent Application No. 10-2019-0149283 filed on Nov. 20, 2019 in the Korean Intellectual Property Office, the entire disclosure of which is incorporated herein by reference for all purposes.

BACKGROUND

1. Field

The following description relates to an antenna apparatus.

2. Description of Background

Mobile communications data traffic has increased on an annual basis. Various techniques have been actively developed to support rapidly increasing data in wireless networks in real time. For example, conversion of Internet of Things (IoT)-based data into contents, augmented reality (AR), virtual reality (VR), live VR/AR linked with SNS, an automatic driving function, applications such as a sync view (transmission of real-time images from a user's viewpoint using a compact camera), and the like, may require communications (e.g., 5G communications, mmWave communications, and the like) which support the transmission and reception of large volumes of data.

Accordingly, there has been a large amount of research on mmWave communications including 5th generation (5G), and the research into the commercialization and standardization of an antenna apparatus for implementing such communications has been increasingly conducted.

A radio frequency (RF) signal of a high frequency band (e.g., 24 GHz, 28 GHz, 36 GHz, 39 GHz, 60 GHz, and the like) may easily be absorbed and lost while being transmitted, which may degrade quality of communications. Thus, an antenna for communications performed in a high frequency band may require a technical approach different from techniques used in a general antenna, and a special technique such as a separate power amplifier, and the like, may be required to secure antenna gain, integration of an antenna and an RFIC, effective isotropic radiated power (EIRP), and the like.

SUMMARY

This Summary is provided to introduce a selection of concepts in simplified form that are further described below in the Detailed Description. This Summary is not intended to identify key features or essential features of the claimed subject matter, nor is it intended to be used as an aid in determining the scope of the claimed subject matter.

An antenna apparatus which may improve antenna performance (e.g., gain, bandwidth, directivity, etc.), and/or may be easily miniaturized.

In one general aspect, an antenna apparatus includes a ground plane; a first patch antenna pattern disposed above and spaced apart from a first surface of the ground plane; a second patch antenna pattern disposed above and spaced apart from the first surface of the ground plane, and spaced apart from the first patch antenna pattern; a first feed via configured to provide a first feed path of the first patch antenna pattern through a first point of the first patch antenna pattern, and disposed adjacent to an edge of the first patch antenna pattern in a direction in which the first point is spaced apart from the second patch antenna pattern; a second feed via configured to provide a second feed path of the second patch antenna pattern through a second point of the second patch antenna pattern, and disposed adjacent to an edge of the second patch antenna pattern in a direction in which the second point is spaced apart from the first patch antenna pattern; and a first coupling pattern disposed between the first patch antenna pattern and the second patch antenna pattern, and spaced apart from the first patch antenna pattern and the second patch antenna pattern, and configured to define a first internal space of the first coupling pattern that is exposed towards the first patch antenna pattern.

The antenna apparatus may include a second coupling pattern disposed between the second patch antenna pattern and the first coupling pattern, and spaced apart from the first coupling pattern, and configured to define a second internal space of the second coupling pattern that is exposed towards the second patch antenna pattern.

The antenna apparatus may include a first ground via electrically connecting the first coupling pattern to the ground plane; and a second ground via electrically connecting the second coupling pattern to the ground plane.

The first ground via may be electrically connected to a point of the first coupling pattern adjacent to the second coupling pattern, and the second ground via may be electrically connected to a point of the second coupling pattern adjacent to the first coupling pattern.

A gap between the first coupling pattern and the second coupling pattern may be smaller than a gap between the first coupling pattern and the first patch antenna pattern.

A length of the first coupling pattern along a direction perpendicular to a direction in which the first and second coupling patterns oppose each other may be larger than a width of the first coupling pattern.

The antenna apparatus may include an upper coupling pattern disposed above and spaced apart from the first coupling pattern and the second coupling pattern such that the first coupling pattern and the second coupling pattern are disposed between the ground plane and the upper coupling pattern along a direction perpendicular to the first surface of the ground plane, and configured to overlap the first coupling pattern and the second coupling pattern in the direction perpendicular to the first surface of the ground plane.

The upper coupling pattern may be configured to overlap a gap between the first coupling pattern and the second coupling pattern, the first internal space of the first coupling pattern, and the second internal space of the second coupling pattern in a direction perpendicular to the first surface of the ground plane.

The antenna apparatus may include a first upper patch pattern disposed above and spaced apart from the first patch antenna pattern; a second upper patch pattern disposed above and spaced apart from the second patch antenna pattern; and a supplementary patch pattern spaced apart from the upper coupling pattern along a direction different from at least one direction in which the supplementary patch pattern spaced is apart from the first upper patch pattern and the second upper patch pattern.

The supplementary patch pattern may include a plurality of supplementary patch patterns spaced apart from each other, and each having a size smaller than a size of the upper coupling pattern.

The antenna apparatus may include a first upper patch pattern disposed above and spaced apart from the first patch antenna pattern; a second upper patch pattern disposed above and spaced apart from the second patch antenna pattern; and an upper coupling pattern disposed above and spaced apart from the first coupling pattern, and configured to overlap the first coupling pattern in a direction perpendicular to the first surface of the ground plane.

The antenna apparatus may include a third patch antenna pattern disposed above and spaced apart from the first surface of the ground plane, and spaced apart from the first patch antenna pattern and the second patch antenna pattern; a fourth patch antenna pattern disposed above and spaced apart from the first surface of the ground plane and spaced apart from the first patch antenna pattern, the second patch antenna pattern, and the third patch antenna pattern; a third coupling pattern disposed between the first patch antenna pattern and the third patch antenna pattern, and spaced apart from the first patch antenna pattern and the third patch antenna pattern, and configured to define a third internal space of the third coupling pattern that is exposed towards the first patch antenna pattern; and a fourth coupling pattern disposed between the second patch antenna pattern and the fourth patch antenna pattern, and spaced apart from the second patch antenna pattern and the fourth patch antenna pattern, and configured to define a fourth internal of the fourth coupling pattern space that is exposed towards the second patch antenna pattern.

The antenna apparatus may include a fifth coupling pattern disposed between the third patch antenna pattern and the fourth patch antenna pattern, and configured to define a fifth internal space of the fifth coupling pattern that is exposed towards the third patch antenna pattern; a sixth coupling pattern spaced disposed between the third patch antenna pattern and the third coupling pattern, and spaced apart from the third coupling pattern, and configured to define a sixth internal space of the sixth coupling pattern that is exposed towards the third patch antenna pattern; a seventh coupling pattern disposed between the fourth patch antenna pattern and the fourth coupling pattern, and spaced apart from the fourth coupling pattern, and configured to define a seventh internal space of the seventh coupling pattern that is exposed towards the fourth patch antenna pattern; and an eighth coupling pattern disposed between the fourth patch antenna pattern and the fifth coupling pattern, and spaced apart from the fifth coupling pattern, and configured to define an eighth internal space of the eighth coupling pattern that is exposed towards the fourth patch antenna pattern.

The antenna apparatus may include a third feed via configured to provide a third feed path of the first patch antenna pattern through a third point of the first patch antenna pattern, and disposed adjacent to an edge of the first patch antenna pattern in a direction in which the third point is spaced apart from the third patch antenna pattern; a fourth feed via configured to provide a fourth feed path of the second patch antenna pattern through a fourth point of the second patch antenna pattern, and disposed adjacent to an edge of the second patch antenna pattern in a direction in which the fourth point is spaced apart from the fourth patch antenna pattern; a fifth feed via configured to provide a fifth feed path of the third patch antenna pattern through a fifth point of the third patch antenna pattern, and disposed adjacent to an edge of the third patch antenna pattern in a direction in which the fifth point is spaced apart from the fourth patch antenna pattern; a sixth feed via configured to provide a sixth feed path of the third patch antenna pattern through a sixth point of the third patch antenna pattern, and disposed adjacent to an edge of the third patch antenna pattern in a direction in which the sixth point is spaced apart from the first patch antenna pattern; a seventh feed via configured to provide a seventh feed path of the fourth patch antenna pattern through a seventh point of the fourth patch antenna pattern, and disposed adjacent to an edge of the fourth patch antenna pattern in a direction in which the seventh point is spaced apart from the second patch antenna pattern; and an eighth feed via configured to provide an eighth feed path of the fourth patch antenna pattern through an eighth point of the fourth patch antenna pattern, and disposed adjacent to an edge of the fourth patch antenna pattern in a direction in which the eighth point is spaced apart from the third patch antenna pattern.

The antenna apparatus may include a fifth coupling pattern disposed between the third patch antenna pattern and fourth patch antenna patterns, and configured to define a fifth internal space exposed towards the third patch antenna pattern; and a plurality of upper coupling patterns disposed above and spaced apart from the first coupling pattern, the second coupling pattern, the third coupling pattern, the fourth coupling pattern, and the fifth coupling pattern such that the first coupling pattern, the second coupling pattern, the third coupling pattern, the fourth coupling pattern, and the fifth coupling pattern are disposed between the ground plane and the upper coupling patterns along a direction perpendicular to the first surface of the ground plane, and configured to overlap the first coupling pattern, the second coupling pattern, the third coupling pattern, the fourth coupling pattern, and the fifth coupling pattern in the direction perpendicular to the first surface of the ground plane.

The antenna apparatus may include a plurality of supplementary patch patterns surrounded by the upper coupling patterns, spaced apart from each other, and each having a size smaller than a size of each of the upper coupling patterns.

The antenna apparatus may include a supplementary patch pattern surrounded by the upper coupling patterns, and a space overlapping the supplementary patch pattern in the direction perpendicular to the first surface of the ground plane and disposed on a same level as the first coupling pattern, the second coupling pattern, the third coupling pattern, the fourth coupling pattern, and the fifth coupling pattern may be formed of a non-conductive material or air.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1A:
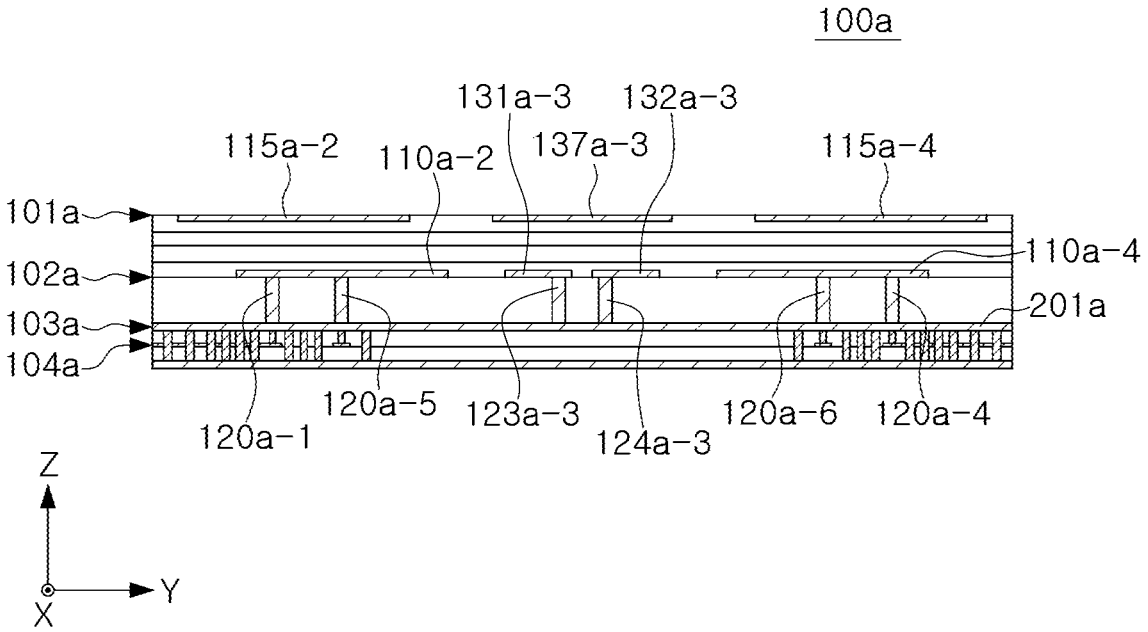
FIG. 1A is a side view of an antenna apparatus according to an example.
Figure 1B:
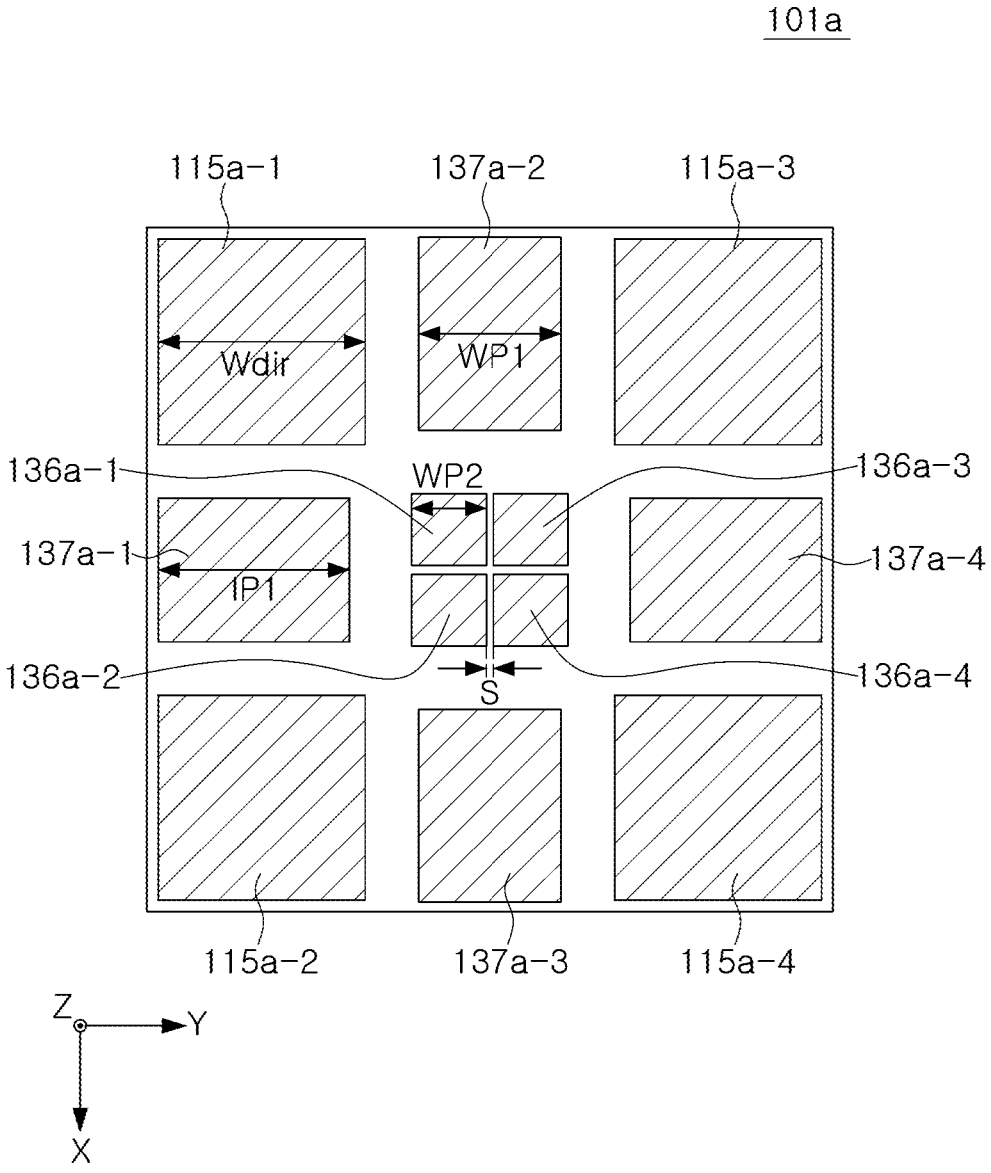
FIGS. 1B, 1C, 1D, and 1E are plan views of an antenna device taken along z direction in order in a-z direction according to an example.
Figure 1C:
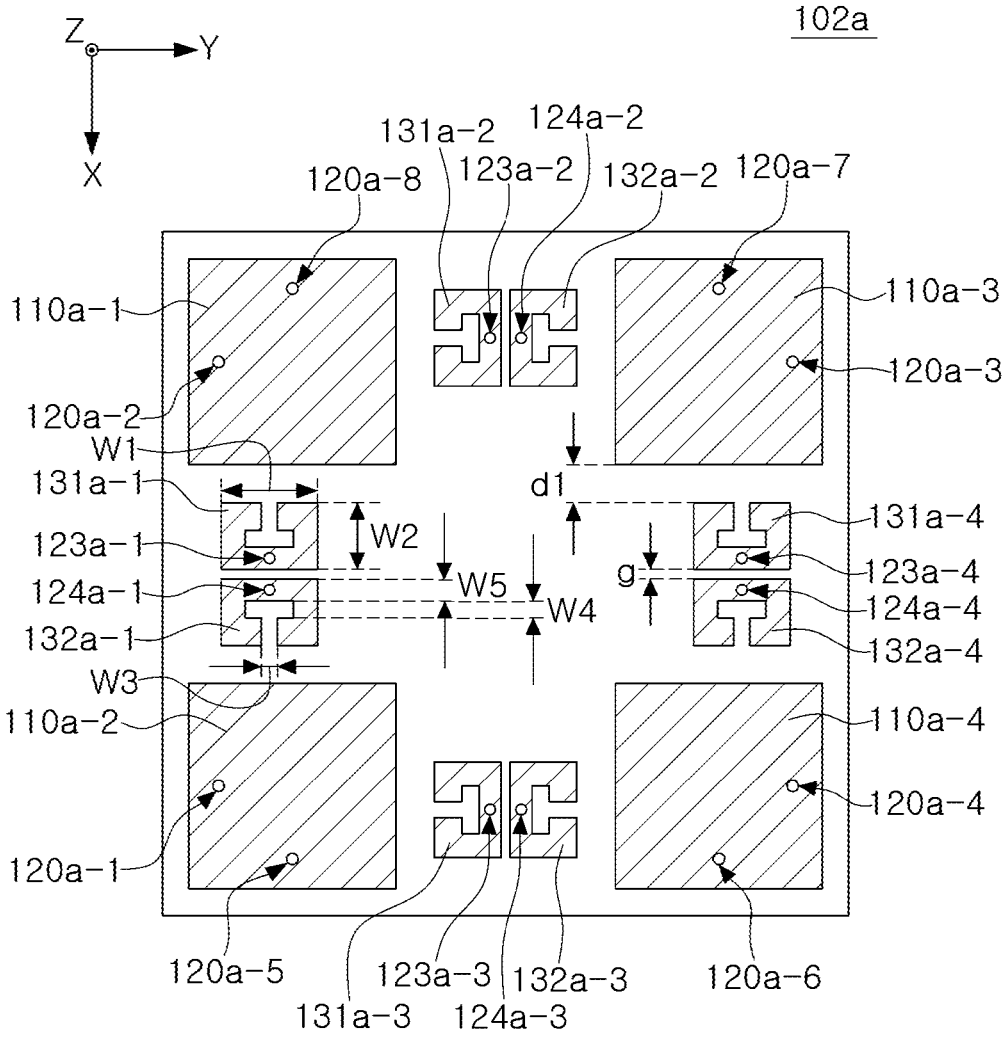

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed as will be apparent to one of ordinary skill in the art, with the exception of operations necessarily occurring in a certain order. Also, descriptions of functions and constructions that would be well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will fully convey the scope of the disclosure to one of ordinary skill in the art.

Herein, it is noted that use of the term "may" with respect to an example or embodiment, e.g., as to what an example or embodiment may include or implement, means that at least one example or embodiment exists in which such a feature is included or implemented while all examples and embodiments are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

Hereinafter, examples will be described as follows with reference to the attached drawings.

FIG. 1A is a cross-sectional diagram illustrating an antenna apparatus according to an example. FIGS. 1B through 1E are plan diagrams illustrating an antenna device taken along z direction in order in a-z direction according to an example.

An antenna apparatus 100*a* may have a stack structure in which a plurality of conductive layers and a plurality of dielectric layers are alternately disposed. At least some of the plurality of dielectric layers may be replaced with air. The stack structure may be implemented as a printed circuit substrate (PCB), but embodiment configuration thereof is not limited thereto.

Referring to FIGS. 1A through 1E, the antenna apparatus 100*a* may include a first conductive layer 101*a*, a second conductive layer 102*a*, a third conductive layer 103*a*, and a fourth conductive layer 104*a*. A spacing distance between the conductive layers may be appropriately controlled.

For example, the first, second, third, and fourth conductive layers 101*a*, 102*a*, 103*a*, and 104*a* may be disposed in at least portions of upper surfaces or lower surfaces of the corresponding dielectric layers, respectively, to include a pre-designed conductive pattern or a pre-designed conductive plane, and may be connected to each other in upward and/or downward directions (e.g., +/−z directions) through a conductive via. A width of the conductive via may be appropriately adjusted.

Referring to FIGS. 1A through 1 E, the antenna apparatus 100*a* may include a ground plane 201*a*, a first patch antenna pattern 110*a*-1, a second patch antenna pattern 110*a*-2, a first feed via 120*a*-8, a second feed via 120*a*-5, and a first coupling pattern 131*a*-1.

The ground plane 201*a* may be disposed on the third conductive layer 103*a*, and may work as a reference of impedance corresponding to a resonant frequency of each of the first and second patch antenna patterns 110*a*-1 and 110*a*-2.

The ground plane 201*a* may reflect a radio frequency (RF) signal radiated from the first and second patch antenna patterns 110*a*-1 and 110*a*-2, and accordingly, a direction in which radiation patterns of the first and second patch antenna patterns 110*a*-1 and 110*a*-2 are formed may be concentrated in a z direction, and gains of the first and second patch antenna patterns 110*a*-1 and 110*a*-2 may improve.

For example, the ground plane 201*a* may include at least one through-hole which the first and second feed vias 120*a*-8 and 120*a*-5 penetrate, respectively. Accordingly, an electrical length of a feed path provided to the first and second patch antenna patterns 110*a*-1 and 110*a*-2 may be easily reduced.

The first and second patch antenna patterns 110*a*-1 and 110*a*-2 may be disposed above and spaced apart from an upper surface of the ground plane 201*a*, and may be spaced apart from each other. The first and second patch antenna patterns 110*a*-1 and 110*a*-2 may be disposed on the second conductive layer 102*a*, but the configuration thereof is not limited thereto. For example, at least one of the first and second patch antenna patterns 110*a*-1 and 110*a*-2 may be disposed on a level higher or lower than the second conductive layer 102*a*.

Each of the first and second patch antenna patterns 110*a*-1 and 110*a*-2 may have a bandwidth based on an intrinsic resonant frequency determined in accordance with an intrinsic element (e.g., a shape, a size, a thickness, a spacing distance, a dielectric constant of a dielectric layer, or others) and an extrinsic resonant frequency determined in accordance with an electromagnetic coupling with an adjacent conductive structure.

When a frequency of an RF signal is included in the bandwidth described above, the first and second patch antenna patterns 110*a*-1 and 110*a*-2 may receive an RF signal from the first and second feed vias 120*a*-8 and 120*a*-5, and may remotely transmit the RF signal in the z direction, or may transfer a remotely received RF signal to the first and second feed vias 120*a*-8 and 120*a*-5. The first and second feed vias 120*a*-8 and 120*a*-5 may provide an electrical connection path between an integrated circuit (IC) and the first and second patch antenna patterns 110*a*-1 and 110*a*-2, and may work as a transmission line of an RF signal.

The first feed via 120*a*-8 may be configured to provide a first feed path of the first patch antenna pattern 110*a*-1 through a point of the first patch antenna pattern 110*a*-1 disposed adjacent to an edge of the first patch antenna pattern 110*a*-1 in a direction (e.g., -x direction) in which the point is spaced apart from the second patch antenna pattern 110*a*-2.

The second feed via 120*a*-5 may be configured to provide a second feed path of the second patch antenna pattern 110*a*-2 through a point of the second patch antenna pattern 110*a*-2 disposed adjacent to an edge of the second patch antenna pattern 110*a*-2 in a direction (e.g., +x direction) in which the point is spaced apart from the first patch antenna pattern 110*a*-1.

The direction in which the first feed via 120*a*-8 is disposed adjacent to the edge of the first patch antenna pattern 110*a*-1 may be opposite to the direction in which the second feed via 120*a*-5 is disposed adjacent to the edge of the second patch antenna pattern 110*a*-2.

Accordingly, the first and second feed paths may be disposed adjacent to an edge of the antenna apparatus 100*a*, an electrical length from the first and second patch antenna patterns 110*a*-1 and 110*a*-2 to an IC may be reduced, and transmission loss of first and second RF signals transmitted to and received from the first and second patch antenna patterns 110*a*-1 and 110*a*-2 may be reduced.

As the direction in which the first feed via 120*a*-8 is adjacent to the edge of the first patch antenna pattern 110*a*-1 is opposite to the direction in which the second feed via 120*a*-5 is adjacent to the edge of the second patch antenna pattern 110*a*-2, the first and second feed paths from the first and second patch antenna patterns 110*a*-1 and 110*a*-2 to the IC may be simplified. Accordingly, an overall size of the antenna apparatus 100*a* may be reduced.

Upper surfaces of the first and second patch antenna patterns 110*a*-1 and 110*a*-2 may work as a space in which a surface current flows, and electromagnetic energy corresponding to the surface current may be radiated towards the air in normal directions of upper surfaces of the first and second patch antenna patterns 110*a*-1 and 110*a*-2 in accordance with resonance of the first and second patch antenna patterns 110*a*-1 and 110*a*-2, respectively. The position in which the first and second feed vias 120*a*-8 and 120*a*-5 provide the first and second feed paths may work as a reference point of the surface current.

As the direction in which the first feed via 120*a*-8 is adjacent to the edge of the first patch antenna pattern 110*a*-1 is opposite to the direction in which the second feed via 120*a*-5 is adjacent to the edge of the second patch antenna pattern 110*a*-2, the direction in which a first surface current of the first patch antenna pattern 110*a*-1 flows may be opposite to the direction in which a second surface current of the second patch antenna pattern 110*a*-2 flows.

The directions in which the first and second surface currents flow may correspond to a direction of an electrical field and a direction of a magnetic field, formed when the first and second patch antenna patterns 110*a*-1 and 110*a*-2 remotely transmit and receive an RF signal. As the direction in which the first surface current flows is opposite to the direction in which the second current surface flows, the directions of first and second electrical fields corresponding to the first and second surface currents may be opposite to each other, and the directions of first and second magnetic fields corresponding to the first and second surface currents may be opposite to each other.

Accordingly, overlapping efficiency of the first and second radiation patterns of the first and second patch antenna patterns 110*a*-1 and 110*a*-2 may be an antenna design element.

The first coupling pattern 131*a*-1 may be spaced apart from the first and second patch antenna patterns 110*a*-1 and 110*a*-2 between the first and second patch antenna patterns 110*a*-1 and 110*a*-2, and may be configured to surround a first internal space to expose the first internal space towards the first patch antenna pattern 110*a*-1. A width W4 and an exposed width W3 of the first internal space may be appropriately adjusted. Likewise, a dimension W2 of the first coupling pattern 131*a*-1 in the x-direction may be appropriately adjusted.

The first coupling pattern 131*a*-1 may be electromagnetically coupled to the first patch antenna pattern 110*a*-1, and may thus provide impedance to the first patch antenna pattern 110*a*-1. As the impedance may affect a resonant frequency of the first patch antenna pattern 110*a*-1, the first patch antenna pattern 110*a*-1 may increase a gain or may broaden a bandwidth in accordance with the electromagnetic coupling with the first coupling pattern 131*a*-1.

As the first coupling pattern 131*a*-1 is disposed between the first and second patch antenna patterns 110*a*-1 and 110*a*-2, a first surface current flowing in the first patch antenna pattern 110*a*-1 may electromagnetically flow to the first coupling pattern 131*a*-1 through the coupling. Accordingly, the first coupling pattern 131*a*-1 may additionally provide an area in which the first surface current flows.

As the first coupling pattern 131*a*-1 surrounds a first internal space to expose the first internal space of the first coupling pattern 131*a*-1 towards the first patch antenna pattern 110*a*-1, the first surface current flowing from the first patch antenna pattern 110*a*-1 to the first coupling pattern 131*a*-1 may flow in a direction of returning to the first patch antenna pattern 110*a*-1.

Accordingly, a portion of the first radiation pattern of the first patch antenna pattern 110*a*-1 relatively close to the second patch antenna pattern 110*a*-2 may have electromagnetically harmonious properties with respect to the second radiation pattern of the second patch antenna pattern 110*a*-2.

Accordingly, the first and second radiation patterns of the first and second patch antenna patterns 110*a*-1 and 110*a*-2 may overlap each other electromagnetically in an efficient manner such that an overall gain of the antenna apparatus 100*a* may efficiently improve. The higher the number of the first and second patch antenna patterns 110*a*-1 and 110*a*-2, the more the gain may increase, and the antenna apparatus 100*a* may improve a gain for a size.

Referring to FIGS. 1A through 1E, the antenna apparatus 100*a* may further include a second coupling pattern 132*a*-1 configured to be spaced apart from the first coupling pattern 131*a*-1 between the second patch antenna pattern 110*a*-2 and the first coupling pattern 131*a*-1 and to surround a second internal space to expose the second internal space towards the second patch antenna pattern 110*a*-2.

Accordingly, a second surface current flowing from the second patch antenna pattern 110*a*-2 to the second coupling pattern 132*a*-1 may flow in a direction of returning to the second patch antenna pattern 110*a*-2 such that a portion of the second radiation pattern of the second patch antenna pattern 110*a*-2 relatively adjacent to the first patch antenna pattern 110*a*-1 may have electromagnetically harmonious properties with respect to the first radiation pattern of the first patch antenna pattern 110*a*-1.

Referring to FIGS. 1A through 1E, the antenna apparatus 100*a* may further include a first ground via 123*a*-1 and/or a second ground via 124*a*-1.

The first ground via 123*a*-1 may electrically connect the first coupling pattern 131*a*-1 to the ground plane 201*a*, and the second ground via 124*a*-1 may electrically connect the second coupling pattern 132*a*-1 to the ground plane 201*a*.

Accordingly, the first ground via 123*a*-1 may work as an inductance element of a resonant frequency of the first patch antenna pattern 110*a*-1, and the second ground via 124*a*-1 may work as an inductance element of a resonant frequency of the second patch antenna pattern 110*a*-2. Accordingly, the first and second patch antenna patterns 110*a*-1 and 110*a*-2 may have a relatively broad bandwidth.

The first and second ground vias 123*a*-1 and 124*a*-1 may provide electromagnetically stable properties of a ground of the ground plane 201*a* to the first and second coupling patterns 131*a*-1 and 132*a*-1. Accordingly, a combined structure of the first and second ground vias 123*a*-1 and 124*a*-1 and the first and second coupling patterns 131*a*-1 and 132*a*-1 may reduce electromagnetic noise of the first and second patch antenna patterns 110*a*-1 and 110*a*-2, electromagnetic noise of which may affect the first and second patch antenna patterns 110*a*-1 and 110*a*-2 mutually.

For example, the first ground via 123*a*-1 may be electrically connected to a point of the first coupling pattern 131*a*-1 adjacent to the second coupling pattern 132*a*-1, and the second ground via 124*a*-1 may be electrically connected to a point of the second coupling pattern 132*a*-1 adjacent to the first coupling pattern 131*a*-1.

Accordingly, the first coupling pattern 131*a*-1 may be more intensively electrically coupled to the first patch antenna pattern 110*a*-1 than to the second patch antenna pattern 110*a*-2, and the second coupling pattern 132*a*-1 may be more intensively electrically coupled to the second patch antenna pattern 110*a*-2 than to the first patch antenna pattern 110*a*-1. Accordingly, electromagnetic noise of the first and second patch antenna patterns 110*a*-1 and 110*a*-2, electromagnetic noise of which may affect the first and second patch antenna patterns 110*a*-1 and 110*a*-2 mutually, may be reduced, and the first and second radiation patterns of the first and second patch antenna patterns 110*a*-1 and 110*a*-2 may electromagnetically overlap with each other in an efficient manner.

For example, a gap 'g' between the first and second coupling patterns 131*a*-1 and 132*a*-1 may be smaller than a gap d1 between the first coupling pattern 131*a*-1 and the first patch antenna pattern 110*a*-1, and a length W1 of the first coupling pattern 131*a*-1 and/or the second coupling pattern 132*a*-1 taken in a direction perpendicular to a direction in which the first and second coupling patterns 131*a*-1 and 132*a*-1 oppose each other may be longer than a width W5.

Accordingly, a combined structure of the first and second coupling patterns 131*a*-1 and 132*a*-1 may effectively work as a capacitance element of a resonant frequency of each of the first and second patch antenna patterns 110*a*-1 and 110*a*-2, such that the first and second patch antenna patterns 110*a*-1 and 110*a*-2 may have a broad bandwidth.

Referring to FIGS. 1A through 1E, at least some of upper coupling patterns 137*a*-1, 137*a*-2, 137*a*-3, and 137*a*-4 included in the antenna apparatus 100*a* may be disposed on the first conductive layer 101*a*.

At least some of the upper coupling patterns 137*a*-1, 137*a*-2, 137*a*-3, and 137*a*-4 may be disposed above and spaced apart from upper surfaces of the first and second coupling patterns 131*a*-1 and 132*a*-1, and may overlap the first and second coupling patterns 131*a*-1 and 132*a*-1 in upward and/or downward directions (e.g., +/−z directions).

Accordingly, a combined structure of the upper coupling patterns 137*a*-1, 137*a*-2, 137*a*-3, and 137*a*-4 and the first and second coupling patterns 131*a*-1 and 132*a*-1 may work as a capacitance element of a resonant frequency of each of the first and second patch antenna patterns 110*a*-1 and 110*a*-2 such that the first and second patch antenna patterns 110*a*-1 and 110*a*-2 may have a broad bandwidth.

For example, at least some of the upper coupling patterns 137*a*-1, 137*a*-2, 137*a*-3, and 137*a*-4 may have a polygonal shape (e.g., a rectangular shape) to overlap a space between the first and second coupling patterns 131*a*-1 and 132*a*-1, the first internal space of the first coupling pattern 131*a*-1, and the second internal space of the second coupling pattern 132*a*-1 in upward and/or downward directions.

A length IP1 and/or a width WP1 of at least some of the upper coupling patterns 137*a*-1, 137*a*-2, 137*a*-3, and 137*a*-4 may be adjusted to correspond to a wavelength corresponding to resonant frequencies of the first and second patch antenna patterns 110*a*-1 and 110*a*-2. The first and second patch antenna patterns 110*a*-1 and 110*a*-2 may have a broad bandwidth using the length IP1 and/or the width WP1 of at least some of the upper coupling patterns 137*a*-1, 137*a*-2, 137*a*-3, and 137*a*-4.

Referring to FIGS. 1A through 1E, a first upper patch pattern 115*a*-1, a second upper patch pattern 115*a*-2, and at least one of supplementary patch patterns 136*a*-1, 136*a*-2, 136*a*-3, and 136*a*-4, included in the antenna apparatus 100*a*, may be disposed on the first conductive layer 101*a*.

As the first and second patch antenna patterns 110*a*-1 and 110*a*-2 are disposed on the second conductive layer 102*a*, the first upper patch pattern 115*a*-1 may be disposed above and spaced apart from an upper surface of the first patch antenna pattern 110*a*-1, and the second upper patch pattern 115*a*-2 may be disposed above and spaced apart from an upper surface of the second patch antenna pattern 110*a*-2.

The first and second upper patch patterns 115*a*-1 and 115*a*-2 may be electromagnetically coupled to the first and second patch antenna patterns 110*a*-1 and 110*a*-2, and may thus provide additional impedance to the first and second patch antenna patterns 110*a*-1 and 110*a*-2. As the first and second patch antenna patterns 110*a*-1 and 110*a*-2 may have additional resonant frequency based on the additional impedance, the first and second patch antenna patterns 110*a*-1 and 110*a*-2 may have a broad bandwidth. A length Wdir of each of the first and second upper patch patterns 115*a*-1 and 115*a*-2 may be appropriately adjusted, and the additional impedance may correspond to the length Wdir of each of the first and second upper patch patterns 115*a*-1 and 115*a*-2.

The supplementary patch patterns 136*a*-1, 136*a*-2, 136*a*-3, and 136*a*-4 may be spaced apart from the upper coupling pattern 137*a*-1 in a direction (e.g., y direction) different from a direction (e.g., x direction) of the first and second upper patch patterns 115*a*-1 and 115*a*-2.

Accordingly, the supplementary patch patterns 136*a*-1, 136*a*-2, 136*a*-3, and 136*a*-4 may be electromagnetically coupled to the upper coupling pattern 137*a*-1, and may affect a resonant frequency of each of the first and second patch antenna patterns 110*a*-1 and 110*a*-2. Accordingly, the first and second patch antenna patterns 110*a*-1 and 110*a*-2 may have a broad bandwidth.

For example, the supplementary patch patterns 136*a*-1, 136*a*-2, 136*a*-3, and 136*a*-4 may include a plurality of supplementary patch patterns 136*a*-1, 136*a*-2, 136*a*-3, and 136*a*-4 each having a dimension WP2 smaller than each of the upper coupling patterns 137*a*-1, 137*a*-2, 137*a*-3, and 137*a*-4, and spaced apart from each other by a predetermined gap 'S'.

Accordingly, a bandwidth of each of the first and second patch antenna patterns 110*a*-1 and 110*a*-2 may be broadened.

Referring to FIGS. 1A through 1 E, at least one of a third upper patch pattern 115*a*-3 and a fourth upper patch pattern 115-4 included in the antenna apparatus 100*a* may be disposed on the first conductive layer 101*a*, and at least one of a third patch antenna pattern 110*a*-3 and a fourth patch antenna pattern 110*a*-4 included in the antenna apparatus 100*a* may be disposed on the second conductive layer 102*a*.

The third patch antenna pattern 110*a*-3 may be disposed above and spaced apart from the ground plane 201*a*, and may be spaced apart from the first and second patch antenna patterns 110*a*-1 and 110*a*-2. The fourth patch antenna pattern 110*a*-4 may be disposed above and spaced apart from the upper surface of the ground plane 201*a*, and may be spaced apart from the first, second, and third patch antenna patterns 110*a*-1, 110*a*-2, and 110*a*-3.

Accordingly, the first, second, third, and fourth patch antenna patterns 110*a*-1, 110*a*-2, 110*a*-3, and 110*a*-4 may be arranged in a lattice structure, and a total number of the patch antenna patterns for an overall size of each of the patch antenna patterns may increase in the antenna apparatus 100*a*, and the antenna apparatus 100*a* in the example may have a relatively high gain for an overall size.

Referring to FIGS. 1A through 1E, the antenna apparatus 100*a* may further include first, second, third, fourth, fifth, sixth, seventh, and eighth feed vias 120*a*-8, 120*a*-5, 120*a*-2, 120*a*-1, 120*a*-7, 120*a*-3, 120*a*-4, and 120*a*-6.

The third feed via 120*a*-2 may be configured to provide a third feed path of the first patch antenna pattern 110*a*-1 through a point of the first patch antenna pattern 110*a*-1 disposed adjacent to an edge of the first patch antenna pattern 110*a*-1 in a direction (e.g., −y direction) in which the point is spaced apart from the third patch antenna pattern 110*a*-3.

The fourth feed via 120*a*-1 may be configured to provide a fourth feed path of the second patch antenna pattern 110*a*-2 through a point of the second patch antenna pattern 110*a*-2 disposed adjacent to an edge of the second patch antenna pattern 110*a*-2 in a direction (e.g., −y direction) in which the point is spaced apart from the fourth patch antenna pattern 110*a*-4.

The fifth feed via 120*a*-7 may be configured to provide a fifth feed path of the third patch antenna pattern 110*a*-3 through a point of the third patch antenna pattern 110*a*-3 disposed adjacent to an edge of the third patch antenna pattern 110*a*-3 in a direction (e.g., −x direction) in which the point is spaced apart from the fourth patch antenna pattern 110*a*-4.

The sixth feed via 120*a*-3 may be configured to provide a sixth feed path of the third patch antenna pattern 110*a*-3 through a point of the third patch antenna pattern 110*a*-3 disposed adjacent to an edge of the third patch antenna pattern 110*a*-3 in a direction (e.g., +y direction) in which the point is spaced apart from the first patch antenna pattern 110*a*-1.

The seventh feed via 120*a*-4 may be configured to provide a seventh feed path of the fourth patch antenna pattern 110*a*-4 through a point of the fourth patch antenna pattern 110*a*-4 disposed adjacent to an edge of the fourth patch antenna pattern 110*a*-4 in a direction (e.g., +y direction) in which the point is spaced apart from the second patch antenna pattern 110*a*-2.

The eighth feed via 120*a*-6 may be configured to provide an eighth feed path of the fourth patch antenna pattern 110*a*-4 through a point of the fourth patch antenna pattern 110*a*-4 disposed adjacent to an edge of the fourth patch antenna pattern 110*a*-4 in a direction (e.g., +x direction) in which the point is spaced apart from the third patch antenna pattern 110*a*-3.

Accordingly, the first, second, third, fourth, fifth, sixth, seventh, and eighth feed vias 120*a*-8, 120*a*-5, 120*a*-2, 120*a*-1, 120*a*-7, 120*a*-3, 120*a*-4, and 120*a*-6 may be disposed adjacent to the edges of the antenna apparatus 100*a*, and an electrical length from the first, second, third, and fourth patch antenna patterns 110*a*-1, 110*a*-2, 110*a*-3, and 110*a*-4 to the IC may be reduced. Also, transmission loss of first, second, third, and fourth RF signals transmitted to and received from the first, second, third, and fourth patch antenna patterns 110*a*-1, 110*a*-2, 110*a*-3, and 110*a*-4 may decrease. Further, the overall first, second, third, fourth, fifth, sixth, seventh, and eighth feed paths may be simplified. Accordingly, an overall size of the antenna apparatus 100*a* may be reduced.

The first, second, third, and fourth patch antenna patterns 110*a*-1, 110*a*-2, 110*a*-3, and 110*a*-4 may be provided with a plurality of feed paths from the plurality of feed vias, respectively. A surface current of an RF signal flowing through one of the plurality of feed vias and a surface current of an RF signal flowing through the other one of the plurality of feed vias may be orthogonal to each other, and may implement a polarized wave. As different pieces of communication data may be included in the plurality of RF signals in a mutual polarized relationship, the first, second, third, and fourth patch antenna patterns 110*a*-1, 110*a*-2, 110*a*-3, and 110*a*-4 may be provided with the plurality of feed paths from the plurality of feed vias, thereby obtaining a relatively high transmission and/or reception rate.

Referring to FIGS. 1A through 1E, at least one of a third coupling pattern 131*a*-2, a fourth coupling pattern 131*a*-3, a fifth coupling pattern 131*a*-4, a sixth coupling pattern 132*a*-2, a seventh coupling pattern 132*a*-3, and an eighth coupling pattern 132*a*-4 may be disposed on the second conductive layer 102*a*.

The third coupling pattern 131*a*-2 may be spaced apart from the first and third patch antenna patterns 110*a*-1 and 110*a*-3 between the first and third patch antenna patterns 110*a*-1 and 110*a*-3, and may be configured to surround a third internal space to expose the third internal space towards the first patch antenna pattern 110*a*-1.

The fourth coupling pattern 131*a*-3 may be spaced apart from the second and fourth antenna patterns 110*a*-2 and 110*a*-4 between the second and fourth antenna patterns 110*a*-2 and 110*a*-4, and may be configured to surround a fourth internal space to expose the fourth internal space towards the second patch antenna pattern 110*a*-2.

The fifth coupling pattern 131*a*-4 may be spaced apart from the third and fourth antenna patterns 110*a*-3 and 110*a*-4 between the third and fourth antenna patterns 110*a*-3 and 110*a*-4, and may be configured to surround a fifth internal space to expose the fifth internal space towards the third patch antenna pattern 110*a*-3.

The sixth coupling pattern 132*a*-2 may be spaced apart from the third coupling pattern 131*a*-2 between the third patch antenna pattern 110*a*-3 and the third coupling pattern 131*a*-2, and may be configured to surround a sixth internal space to expose the sixth internal space towards the third patch antenna pattern 110*a*-3.

The seventh coupling pattern 132*a*-3 may be spaced apart from the fourth coupling pattern 131*a*-3 between the fourth patch antenna pattern 110*a*-4 and the fourth coupling pattern 131*a*-3, and may be configured to surround a seventh internal space to expose the seventh internal space towards the fourth patch antenna pattern 110*a*-4.

The eighth coupling pattern 132*a*-4 may be spaced apart from the fifth coupling pattern 131*a*-4 between the fourth patch antenna pattern 110*a*-4 and the fifth coupling pattern 131*a*-4, and may be configured to surround an eighth internal space to expose the eighth internal space towards the fourth patch antenna pattern 110*a*-4.

Accordingly, a surface current flowing from the first, second, third, and fourth patch antenna patterns 110*a*-1, 110*a*-2, 110*a*-3, and 110*a*-4 to the first, second, third, fourth, fifth, sixth, seventh, and eighth coupling patterns 131*a*-1, 132*a*-1, 131*a*-2, 131*a*-3, 131*a*-4, 132*a*-2, 132*a*-3, and 132*a*-4 may flow in a direction of returning to the first, second, third, and fourth patch antenna patterns 110*a*-1, 110*a*-2, 110*a*-3, and 110*a*-4. Accordingly, a portion of each of radiation patterns of the first, second, third, and fourth patch antenna patterns 110*a*-1, 110*a*-2, 110*a*-3, and 110*a*-4 relatively adjacent to an adjacent patch antenna pattern may have electromagnetically harmonious properties with respect to a radiation pattern of the adjacent patch antenna pattern.

Thus, as first, second, third, and fourth radiation patterns of the first, second, third, and fourth patch antenna patterns 110*a*-1, 110*a*-2, 110*a*-3, and 110*a*-4 may be electromagnetically overlap one another in an efficient manner such that an overall gain of the antenna apparatus 100*a* may improve.

The antenna apparatus 100*a* in the example may further include first, second, third, fourth, fifth, sixth, seventh, and eighth ground vias 123*a*-1, 124*a*-1, 123*a*-2, 123*a*-3, 123*a*-4, 124*a*-2, 124*a*-3, and 124*a*-4 configured to electrically connect the first, second, third, fourth, fifth, sixth, seventh, and eighth coupling patterns 131*a*-1, 132*a*-1, 131*a*-2, 131*a*-3, 131*a*-4, 132*a*-2, 132*a*-3, and 132*a*-4 to the ground plane 201*a*.

Referring to FIGS. 1A through 1E, a space overlapping the supplementary patch patterns 136*a*-1, 136*a*-2, 136*a*-3, and 136*a*-4 in upward and/or downward directions and disposed on a level the same as levels of the first, second, third, fourth, fifth, sixth, seventh, and eighth coupling patterns 131*a*-1, 132*a*-1, 131*a*-2, 131*a*-3, 131*a*-4, 132*a*-2, 132*a*-3, and 132*a*-4 may be formed of a non-conductive material or air.

Accordingly, the dispersion of directions of surface currents of the first, second, third, and fourth patch antenna patterns 110*a*-1, 110*a*-2, 110*a*-3, and 110*a*-4 may be prevented. Accordingly, the first, second, third, and fourth radiation patterns of the first, second, third, and fourth patch antenna patterns 110*a*-1, 110*a*-2, 110*a*-3, and 110*a*-4 may electromagnetically overlap each other in an efficient manner such that an overall gain of the antenna apparatus 100*a* may improve.

Referring to FIGS. 1A through 1E, the fourth conductive layer 104*a* of the antenna apparatus 100*a* in the example may include first, second, third, fourth, fifth, sixth, seventh, and eighth feed lines 220*a*-8, 220*a*-5, 220*a*-2, 220*a*-1, 220*a*-7, 220*a*-3, 220*a*-4, and 220*a*-6 electrically connected to the first, second, third, fourth, fifth, sixth, seventh, and eighth feed vias 120*a*-8, 120*a*-5, 120*a*-2, 120*a*-1, 120*a*-7, 120*a*-3, 120*a*-4, and 120*a*-6, respectively.

Figure 1D:
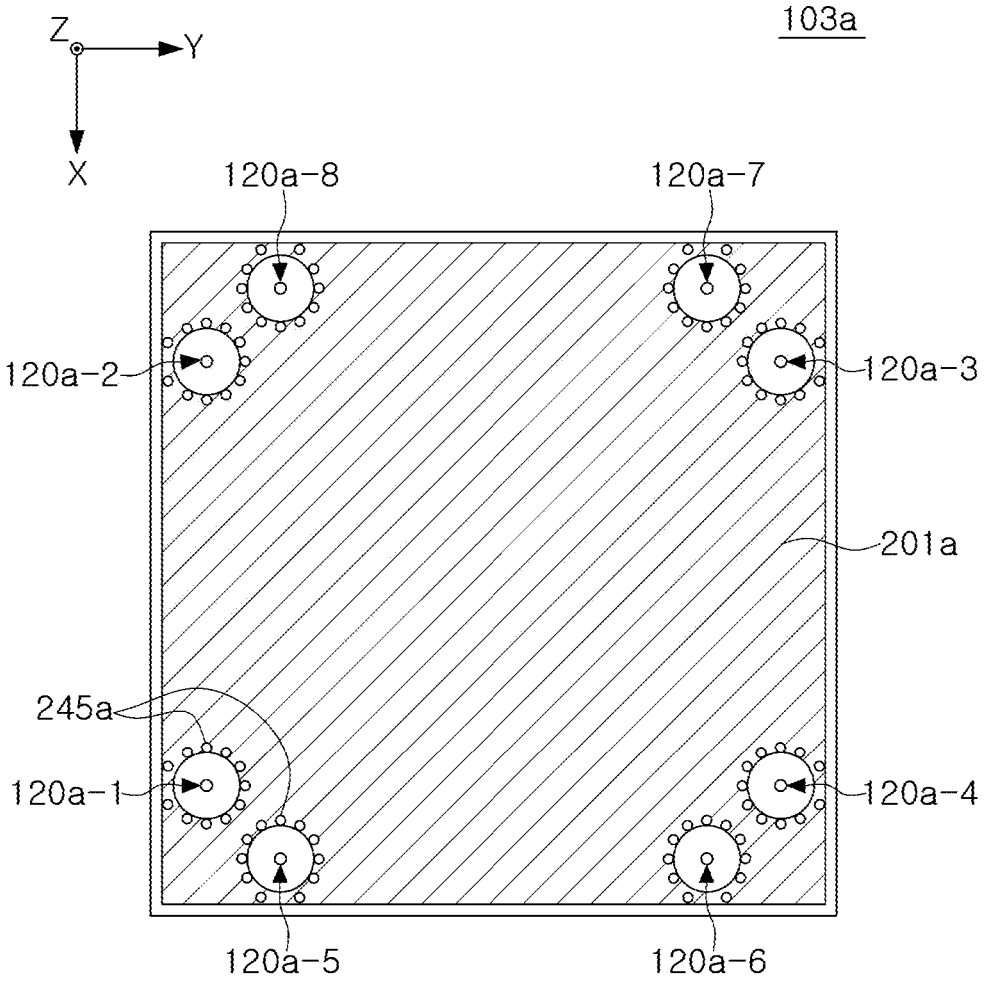
Figure 1E:
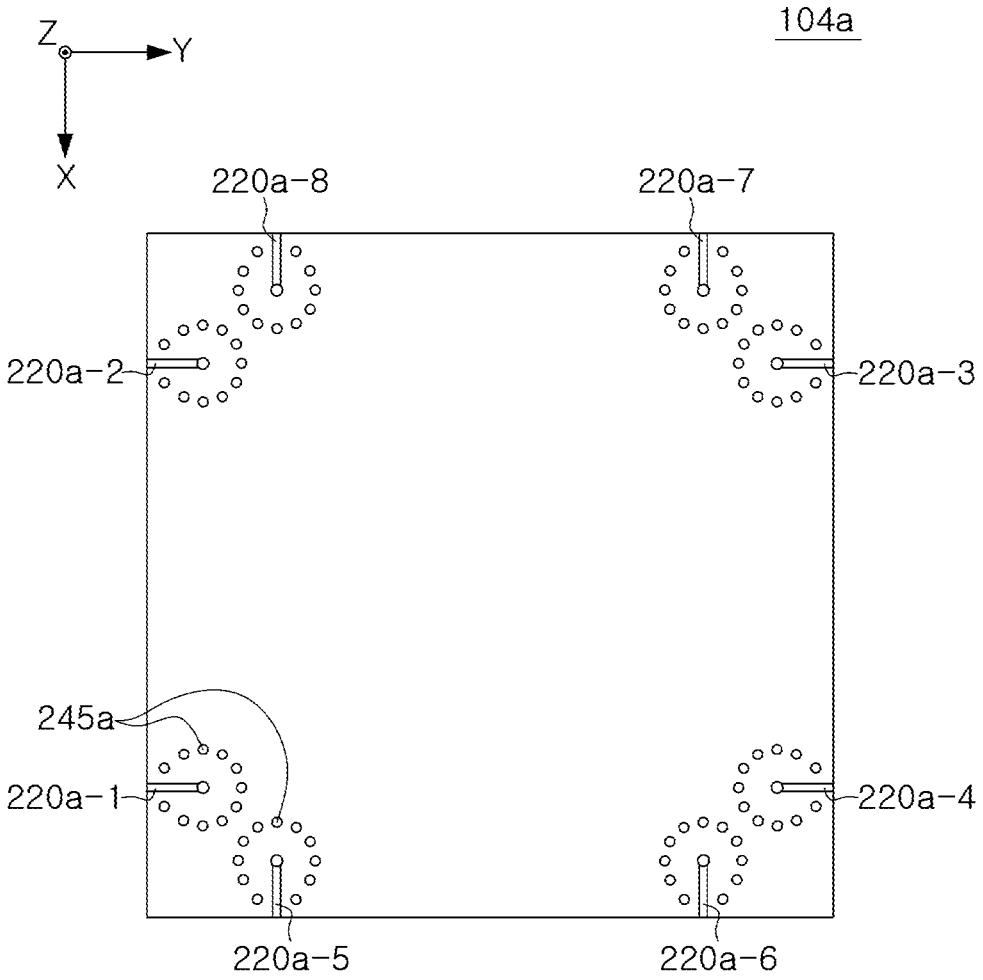

As shown in FIGS. 1D and 1F, the antenna apparatus 100*a* may further include a plurality of shielding vias 245*a* electrically connected to the ground plane 201*a*. The plurality of shielding vias 245*a* may be arranged to surround the first, second, third, fourth, fifth, sixth, seventh, and eighth feed vias 120*a*-8, 120*a*-5, 120*a*-2, 120*a*-1, 120*a*-7, 120*a*-3, 120*a*-4, and 120*a*-6 in upward and/or downward directions (e.g., +/−z directions), respectively.

Figure 2A:
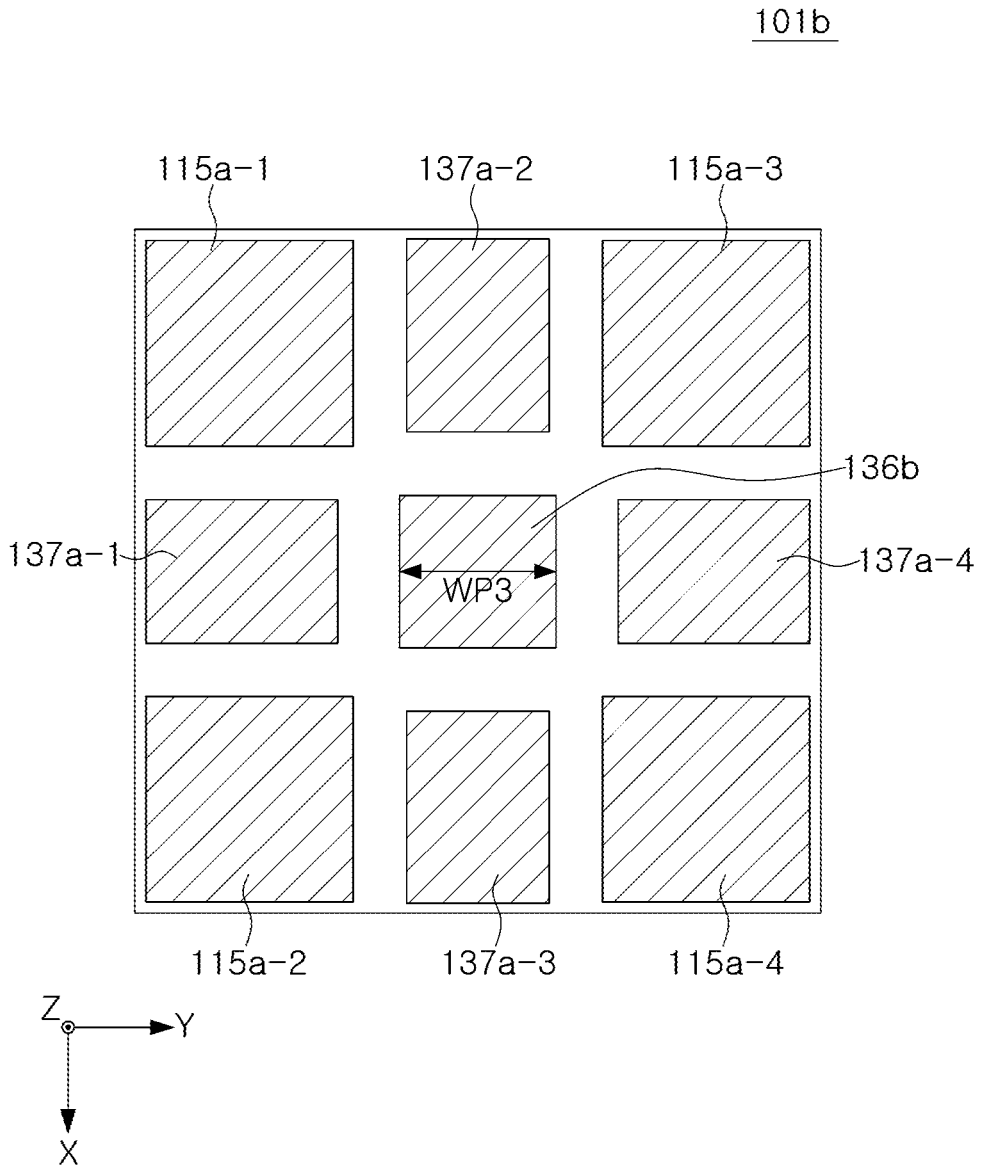
FIGS. 2A, 2B, and 2C are plan views of modified structures of a first conductive layer of an antenna apparatus according to an example.
Figure 2B:
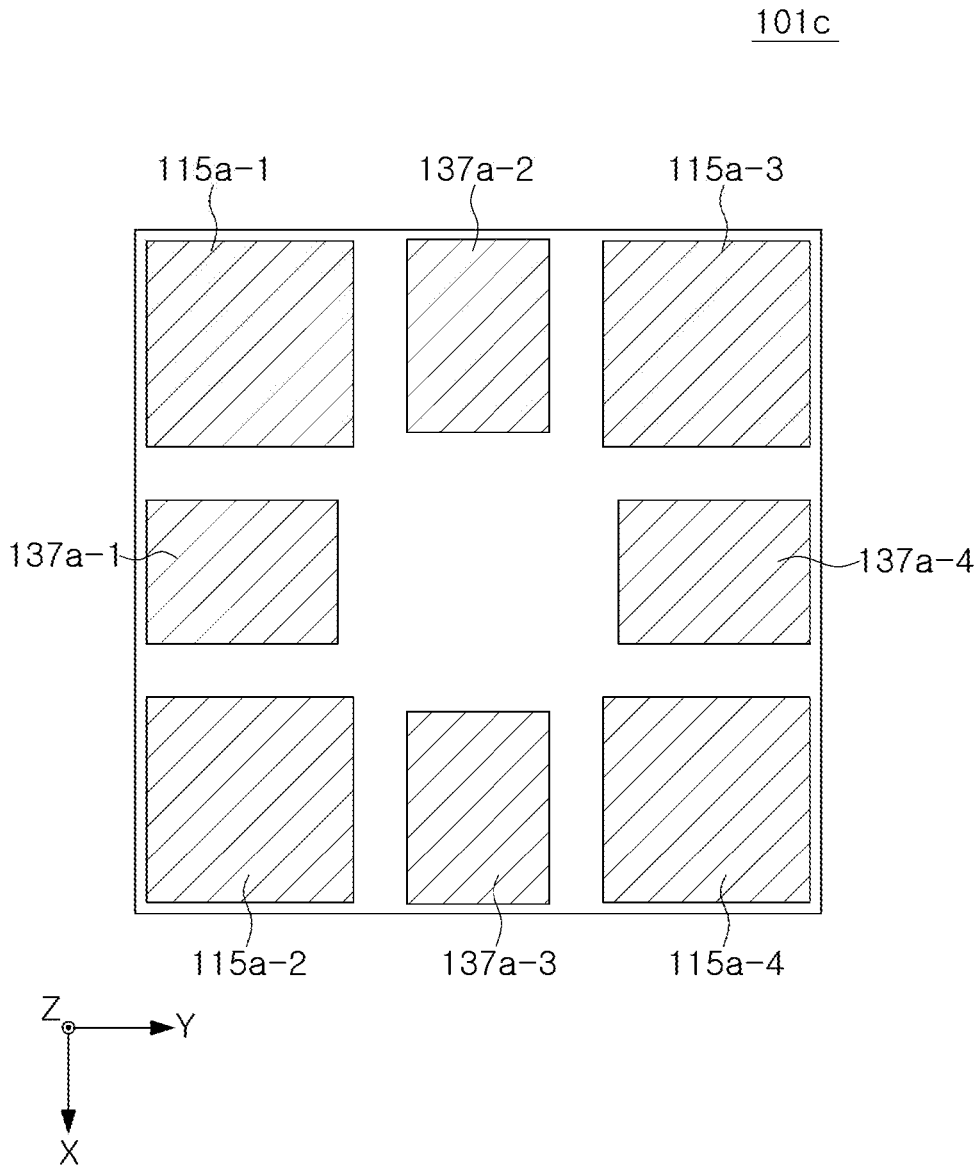
Figure 2C:
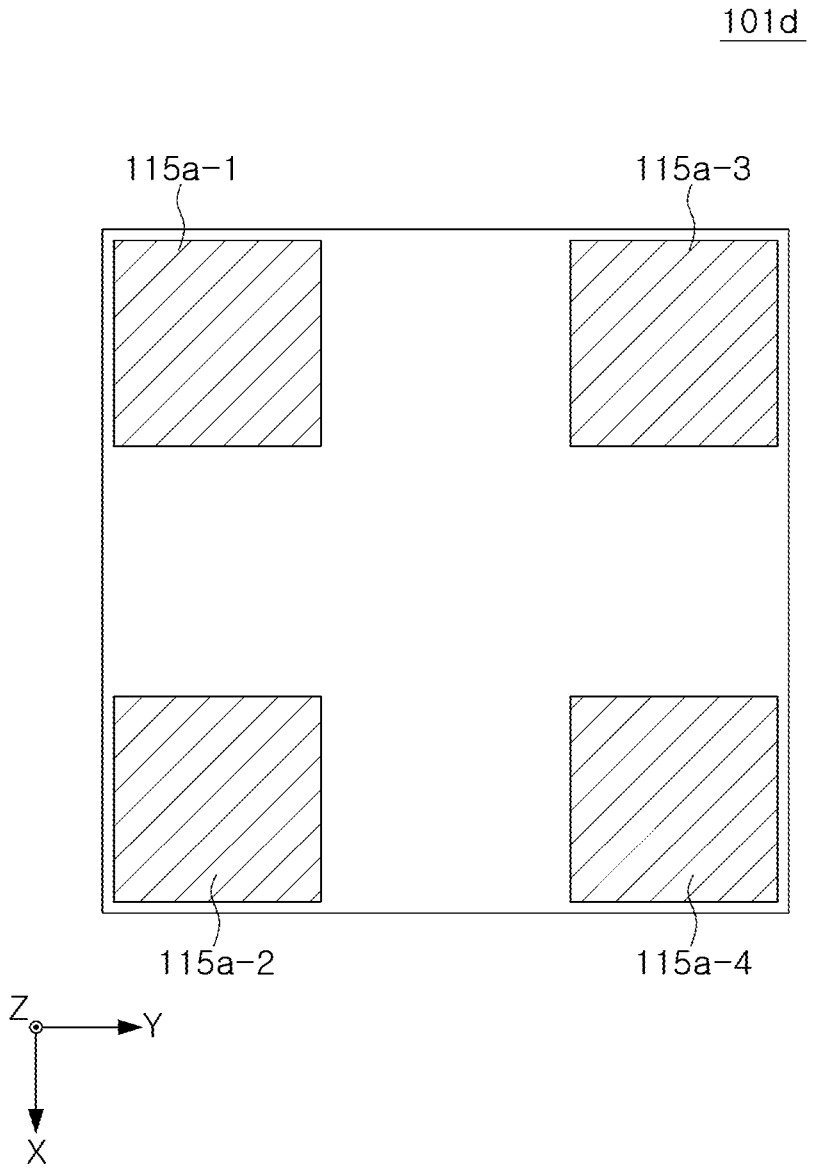

FIGS. 2A through 2C are plan diagrams illustrating modified structures of a first conductive layer of an antenna apparatus according to an example.

Referring to FIG. 2A, a supplementary patch pattern 136*b* disposed on a first conductive layer 101*b* of an antenna apparatus in the example may have a single polygonal shape, which may have a dimension WP3.

Referring to FIG. 2B, a first conductive layer 101*c* of the antenna apparatus in the example may have a structure in which a supplementary patch pattern is not provided.

Referring to FIG. 2C, a first conductive layer 101*d* of the antenna apparatus in the example may have a structure in which an upper coupling pattern is not provided.

Figure 3A:
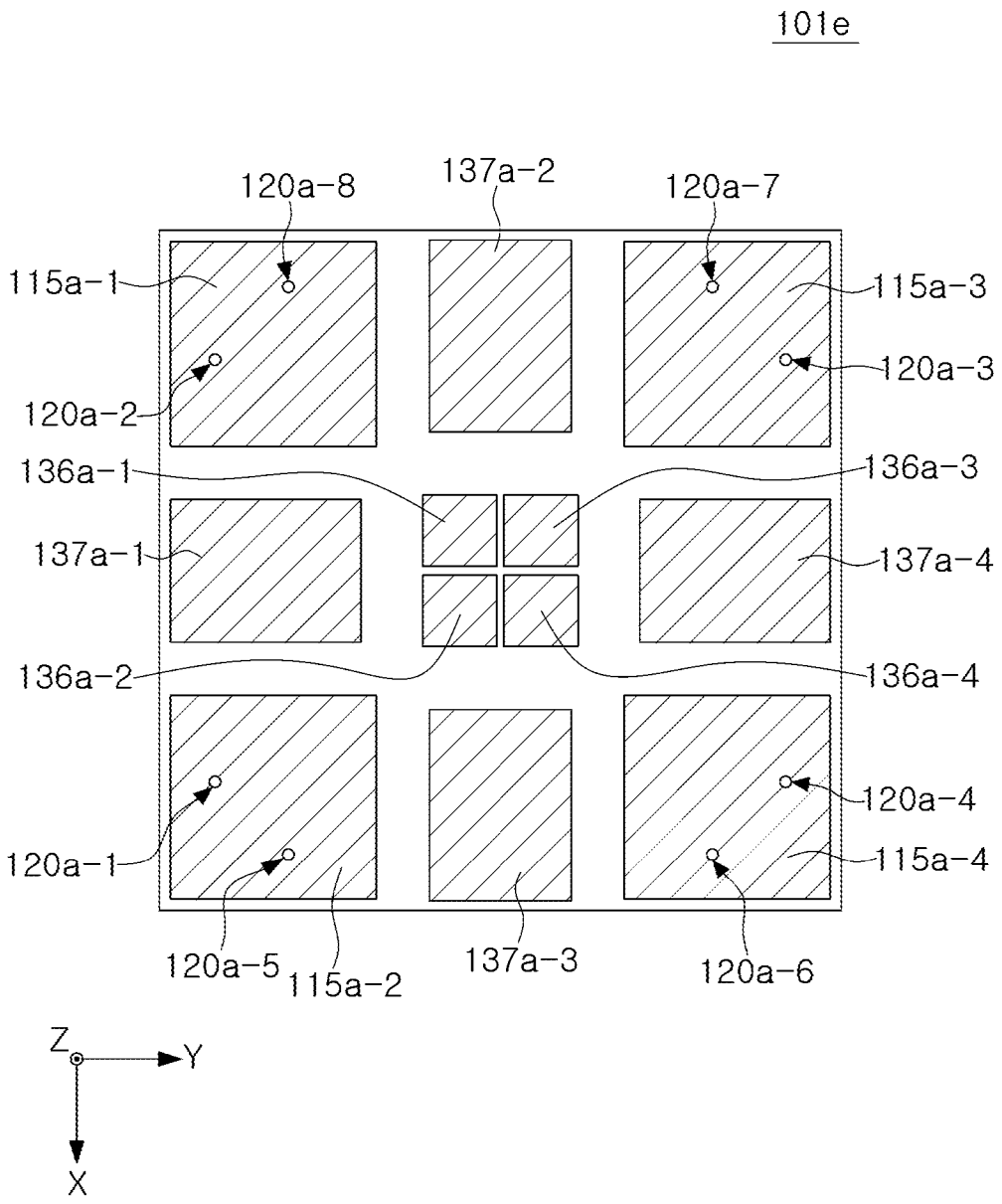
FIGS. 3A and 3B are plan views of a modified structure of an antenna apparatus according to an example.
Figure 3B:
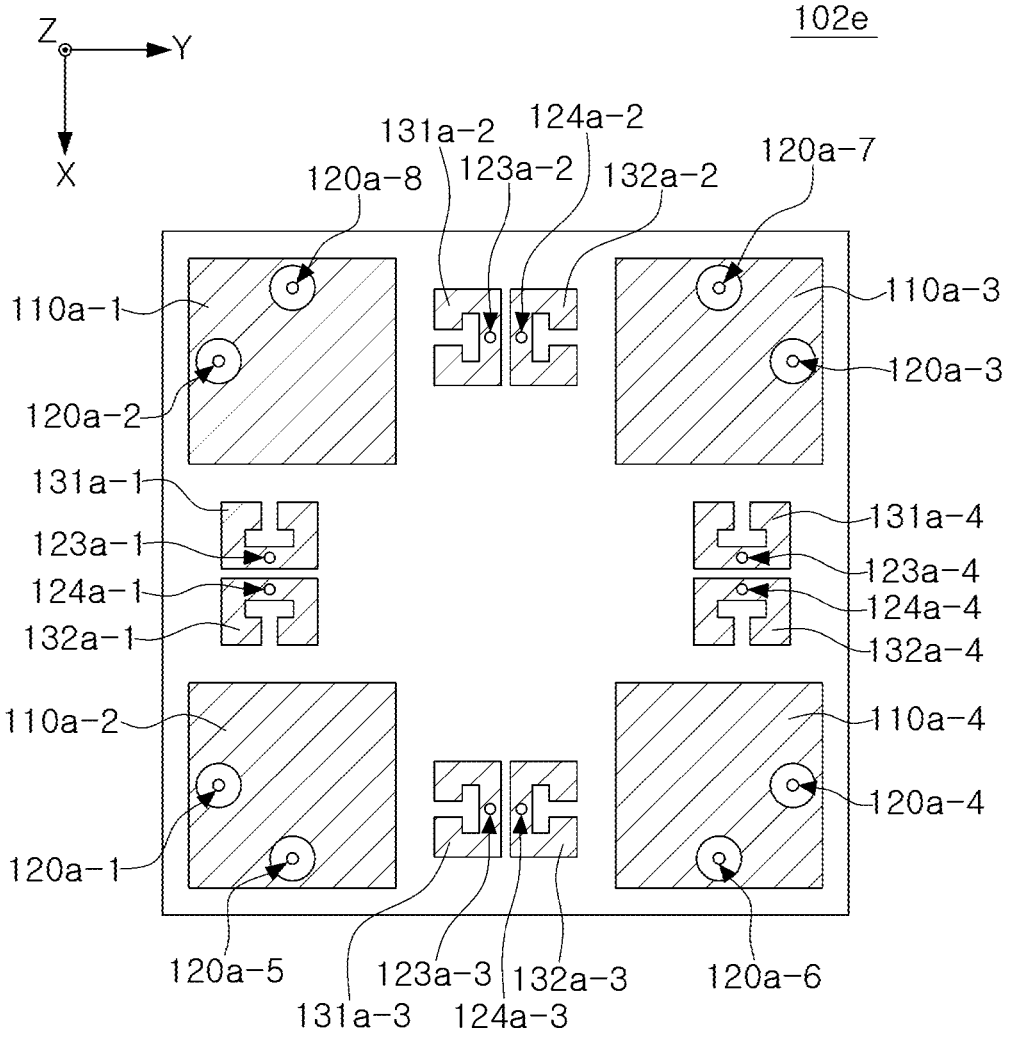

FIGS. 3A and 3B are plan diagrams illustrating a modified structure of an antenna apparatus according to an example.

Referring to FIG. 3A, first, second, third, and fourth upper patch patterns 115*a*-1, 115*a*-2, 115*a*-3, 115*a*-4 of a first conductive layer 101*e* of an antenna apparatus may be electrically connected to at least one of first, second, third, fourth, fifth, sixth, seventh, and eighth feed vias 120*a*-8, 120*a*-5, 120*a*-2, 120*a*-1, 120*a*-7, 120*a*-3, 120*a*-4, and 120*a*-

6, and may be fed with power from the first, second, third, fourth, fifth, sixth, seventh, and eighth feed vias 120*a*-8, 120*a*-5, 120*a*-2, 120*a*-1, 120*a*-7, 120*a*-3, 120*a*-4, and 120*a*-6 in a contact manner.

Referring to FIG. 3B, first, second, third, and fourth patch antenna patterns 110*a*-1, 110*a*-2, 110*a*-3, and 110*a*-4 of a second conductive layer 102*e* of an antenna apparatus may have a through-hole through which at least one of the first, second, third, fourth, fifth, sixth, seventh, and eighth feed vias 120*a*-8, 120*a*-5, 120*a*-2, 120*a*-1, 120*a*-7, 120*a*-3, 120*a*-4, and 120*a*-6 penetrates, and may be fed with power from the first, second, third, fourth, fifth, sixth, seventh, and eighth feed vias 120*a*-8, 120*a*-5, 120*a*-2, 120*a*-1, 120*a*-7, 120*a*-3, 120*a*-4, and 120*a*-6 in a non-contact manner.

For example, each of the first, second, third, and fourth upper patch patterns 115*a*-1, 115*a*-2, 115*a*-3, and 115*a*-4 may have a size smaller than a size of each of the first, second, third, and fourth patch antenna patterns 110*a*-1, 110*a*-2, 110*a*-3, and 110*a*-4, and may be configured to have a resonant frequency higher than a resonant frequency of each of the first, second, third, and fourth patch antenna patterns 110*a*-1, 110*a*-2, 110*a*-3, and 110*a*-4. Accordingly, the antenna apparatus in the example may be configured to have a plurality of different frequency bands (e.g., 28 GHz and 39 GHz).

Figure 4A:
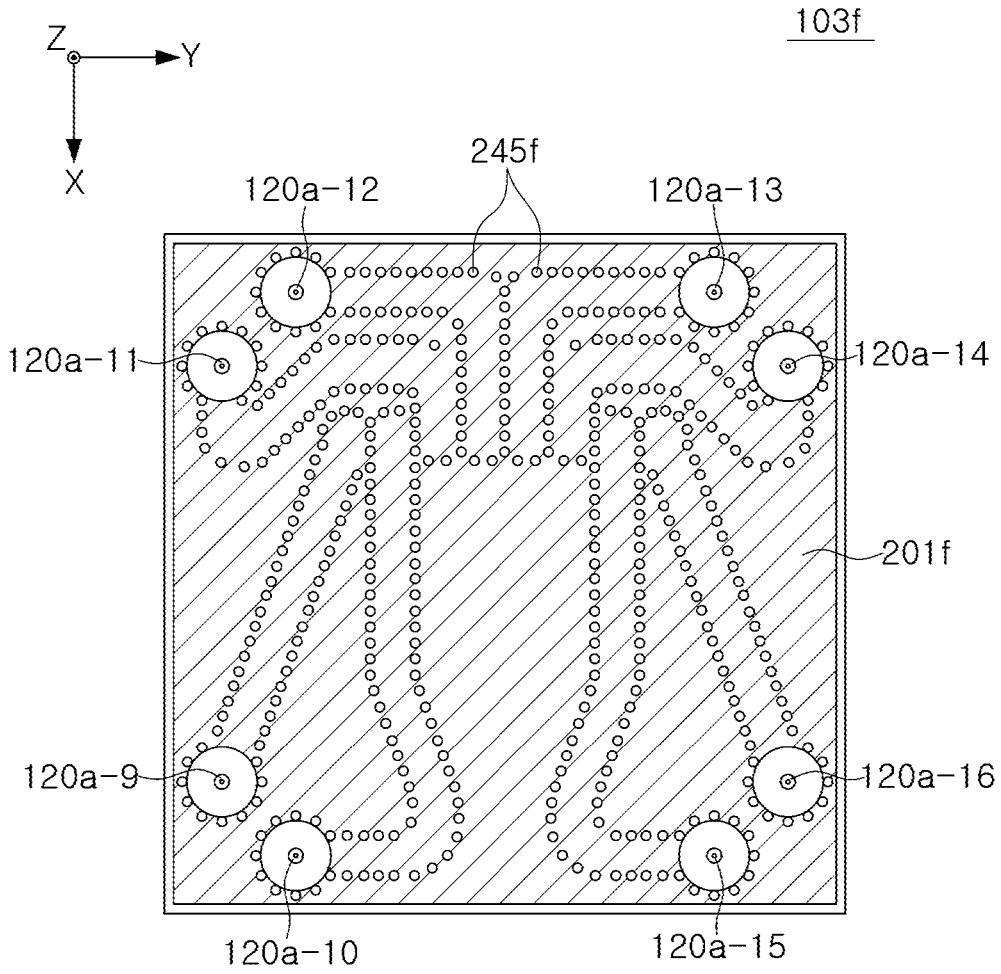
FIG. 4A is a plan view of a modified structure of a ground plane of an antenna apparatus according to an example.
Figure 4B:
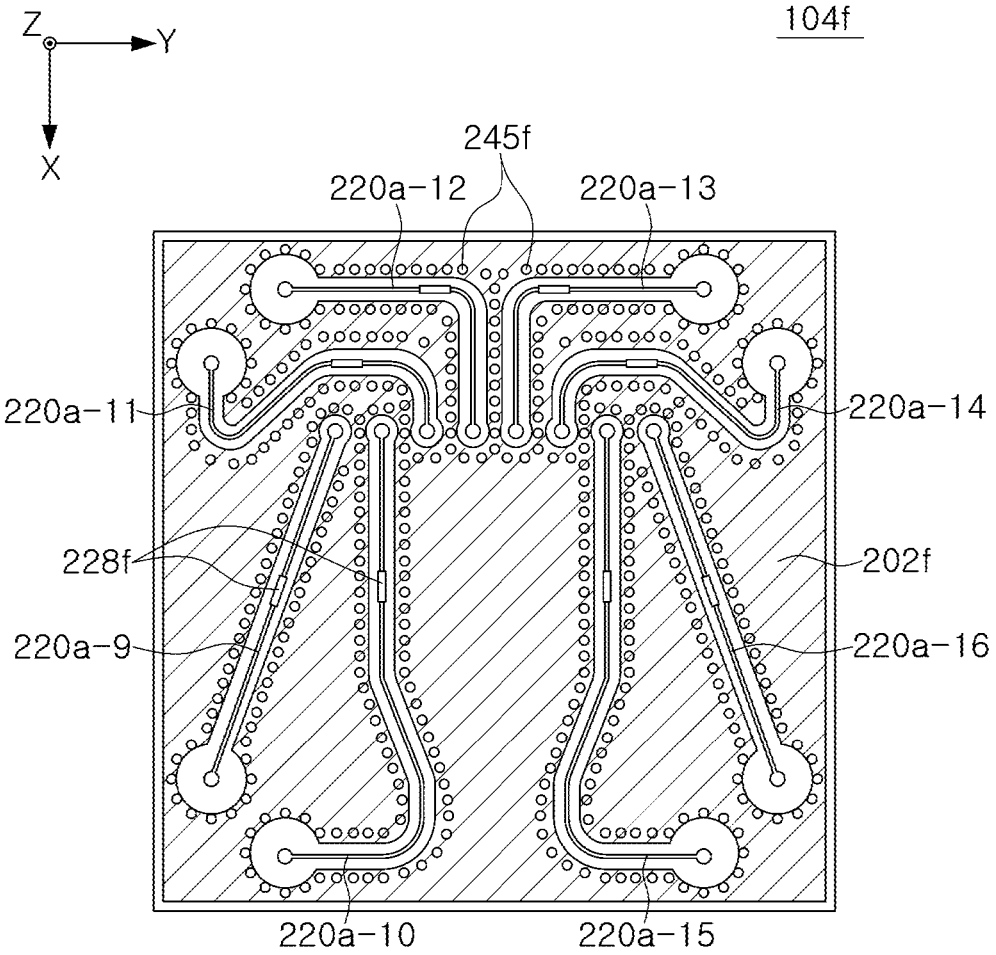
FIGS. 4B, 4C, 4D, and 4E are plan views of a structure disposed lower than a ground plane of an antenna apparatus.

FIG. 4A is a plan diagram illustrating a modified structure of a ground plane of an antenna apparatus according to an example.

Referring to FIG. 4A, an antenna apparatus in the example may include a ground plane 201*f* through which at least one of first, second, third, fourth, fifth, sixth, seventh, and eighth feed vias 120*a*-12, 120*a*-10, 120*a*-11, 120*a*-9, 120*a*-13, 120*a*-14, 120*a*-16, and 120*a*-15 of a third conductive layer 103*f* is configured to penetrate.

The antenna apparatus in the example may further include a plurality of shielding vias 245*f* electrically connected to the ground plane 201*f*. The plurality of shielding vias 245*f* may be arranged to surround the first, second, third, fourth, fifth, sixth, seventh, and eighth feed vias 120*a*-12, 120*a*-10, 120*a*-11, 120*a*-9, 120*a*-13, 120*a*-14, 120*a*-16, and 120*a*-15 in upward and/or downward directions (e.g., +/−z directions), respectively.

FIGS. 4B through 4E are plan diagrams illustrating a structure disposed lower than a ground plane of an antenna apparatus. FIGS. 4F is a cross-sectional diagram illustrating a structure disposed lower than a ground plane of an antenna apparatus.

Referring to FIGS. 4B through 4F, a fourth conductive layer 104*f* of an antenna apparatus in the example may further include a second ground plane 202*f* configured to surround first, second, third, fourth, fifth, sixth, seventh, and eighth feed lines 220*a*-12, 220*a*-10, 220*a*-11, 220*a*-9, 220*a*-13, 220*a*-14, 220*a*-16, and 220*a*-15.

The shielding vias 245*f* may be electrically connected to the second ground plane 202*f*. The plurality of shielding vias 245*f* may be arranged to surround the first, second, third, fourth, fifth, sixth, seventh, and eighth feed lines 220*a*-12, 220*a*-10, 220*a*-11, 220*a*-9, 220*a*-13, 220*a*-14, 220*a*-16, and 220*a*-15 in upward and/or downward directions (e.g., +/−z directions), respectively.

Each of the first, second, third, fourth, fifth, sixth, seventh, and eighth feed lines 220*a*-12, 220*a*-10, 220*a*-11, 220*a*-9, 220*a*-13, 220*a*-14, 220*a*-16, and 220*a*-15 may include an impedance transformer 228*f*.

Figure 4C:
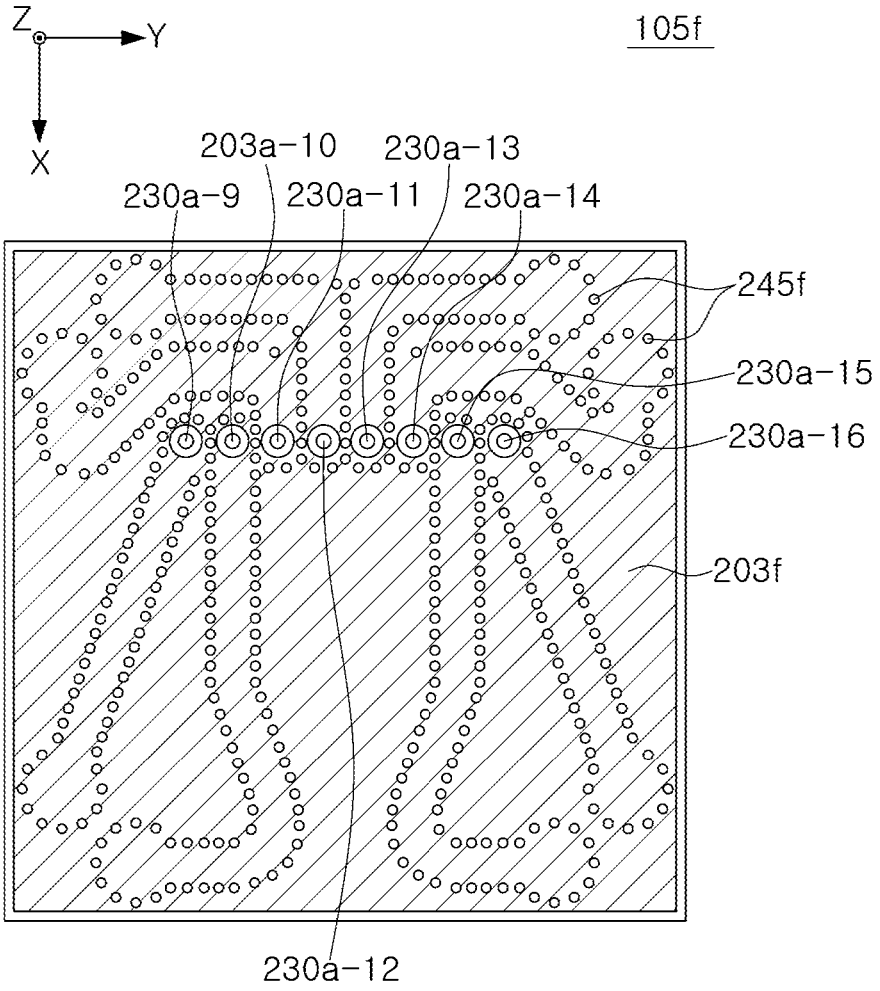
Figure 4D:
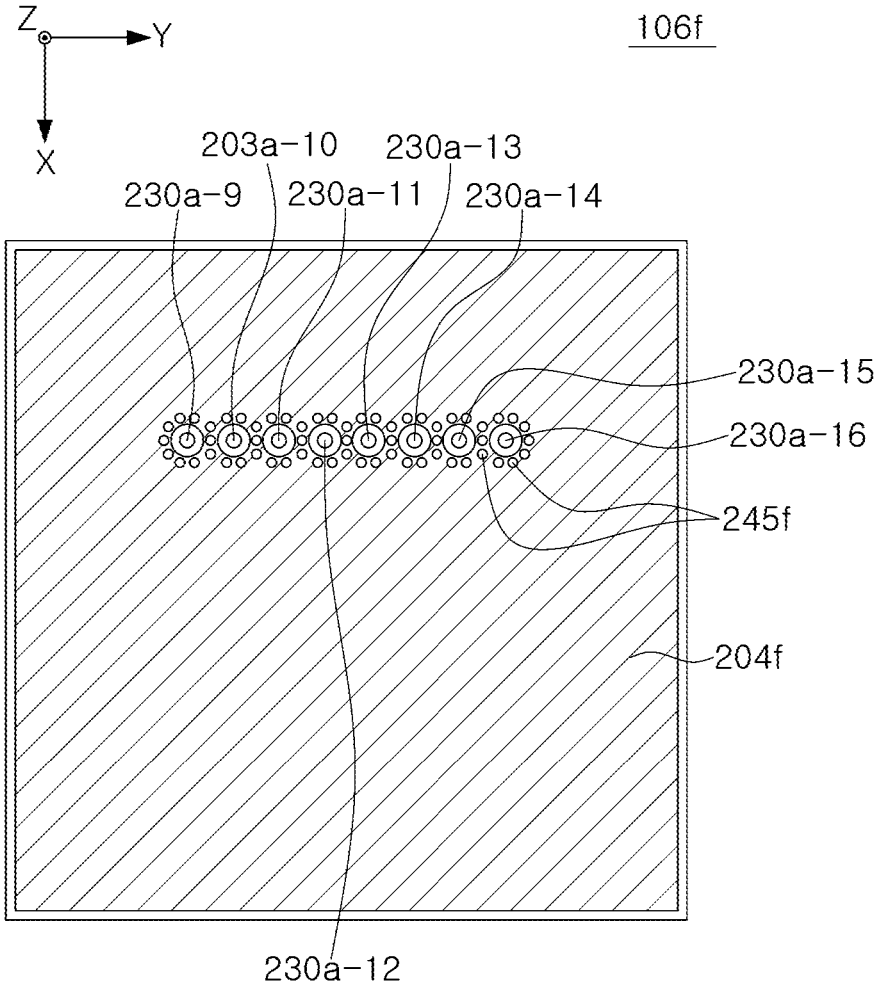
Figure 4E:
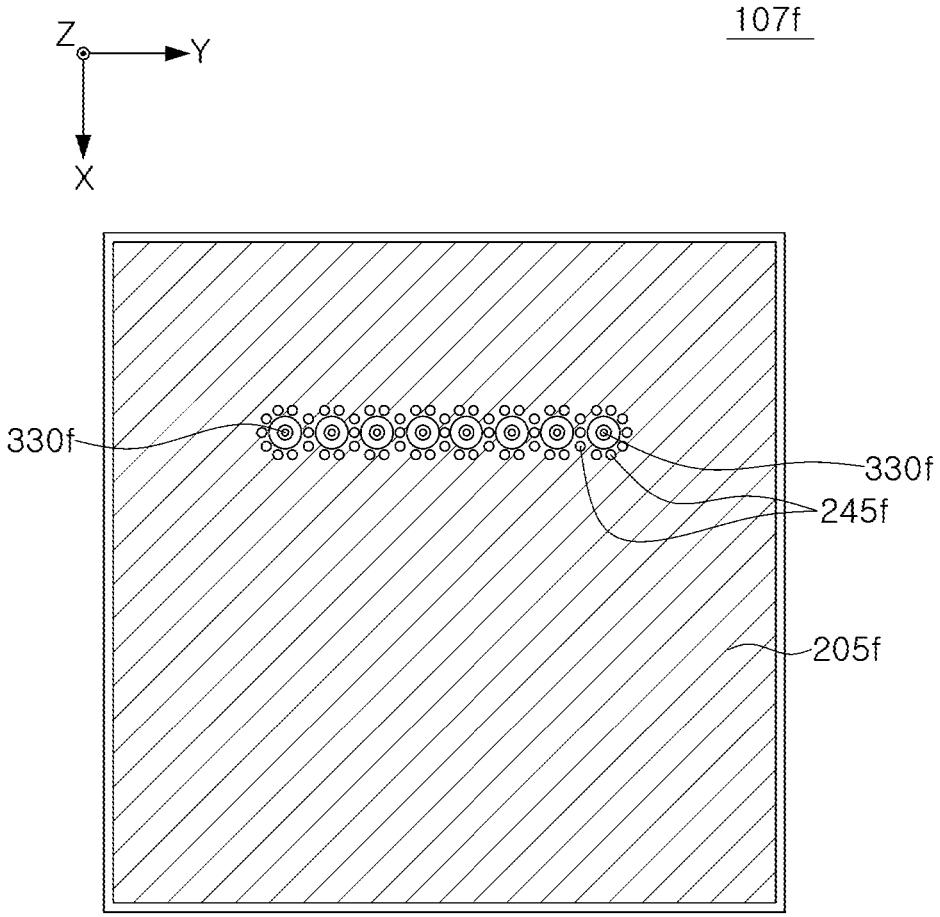
Figure 4F:
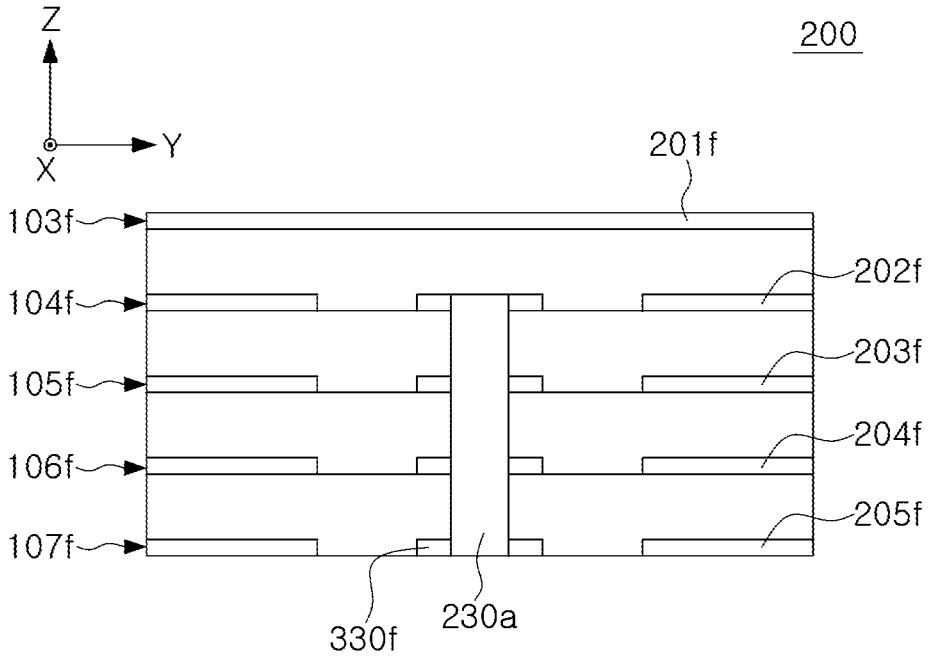
FIGS. 4F is a side view of a structure disposed lower than a ground plane of an antenna apparatus.

Referring to FIGS. 4C, 4D, and 4F, fifth and sixth conductive layers 105*f* and 106*f* of the antenna apparatus in the example may further include third and fourth ground planes 203*f* and 204*f* configured to surround first, second, third, fourth, fifth, sixth, seventh, and eighth wiring vias 230*a*-12, 230*a*-10, 230*a*-11, 230*a*-9, 230*a*-13, 230*a*-14, 230*a*-16, and 230*a*-15.

The first, second, third, fourth, fifth, sixth, seventh, and eighth wiring vias 230*a*-12, 230*a*-10, 230*a*-11, 230*a*-9, 230*a*-13, 230*a*-14, 230*a*-16, and 230*a*-15 may electrically connect the first, second, third, fourth, fifth, sixth, seventh, and eighth feed lines 220*a*-12, 220*a*-10, 220*a*-11, 220*a*-9, 220*a*-13, 220*a*-14, 220*a*-16, and 220*a*-15 to an IC.

The shielding vias 245*f* may be electrically connected to the third and fourth ground planes 203*f* and 204*f*, respectively. The plurality of shielding vias 245*f* may be arranged to surround the first, second, third, fourth, fifth, sixth, seventh, and eighth wiring vias 230*a*-12, 230*a*-10, 230*a*-11, 230*a*-9, 230*a*-13, 230*a*-14, 230*a*-16, and 230*a*-15 in upward and/or downward directions (e.g., +/−z directions), respectively.

Referring to FIGS. 4D, 4E, and 4F, a seventh conductive layer 107*f* of the antenna apparatus in the example may further include a plurality of electrical interconnect structures 330*f* electrically connected to the first, second, third, fourth, fifth, sixth, seventh, and eighth wiring vias 230*a*-12, 230*a*-10, 230*a*-11, 230*a*-9, 230*a*-13, 230*a*-14, 230*a*-16, and 230*a*-15 (collectively 230*a*). The plurality of electrical interconnect structures 330*f* may support the mounting of an IC. A fifth ground plane 205*f* disposed on the seventh conductive layer 107*f* may surround the plurality of electrical interconnect structures 330*f*.

Figure 5A:
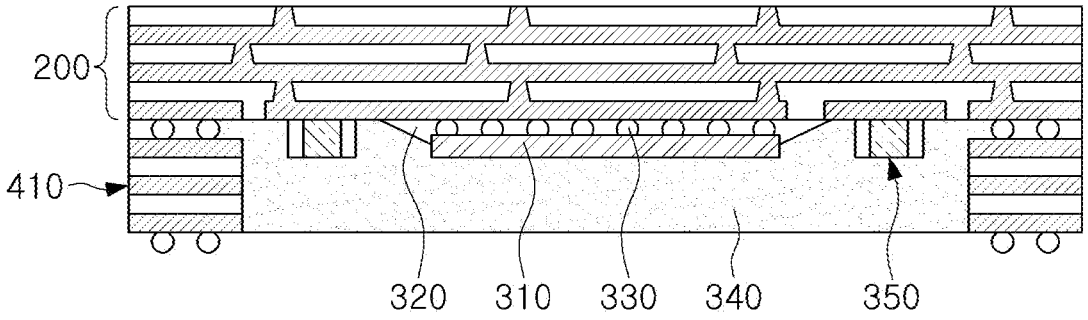
FIGS. 5A and 5B are side views of a connection member on which a ground plane is stacked, included in an antenna device, and a lower structure of the connection member according to an example.
Figure 5B:
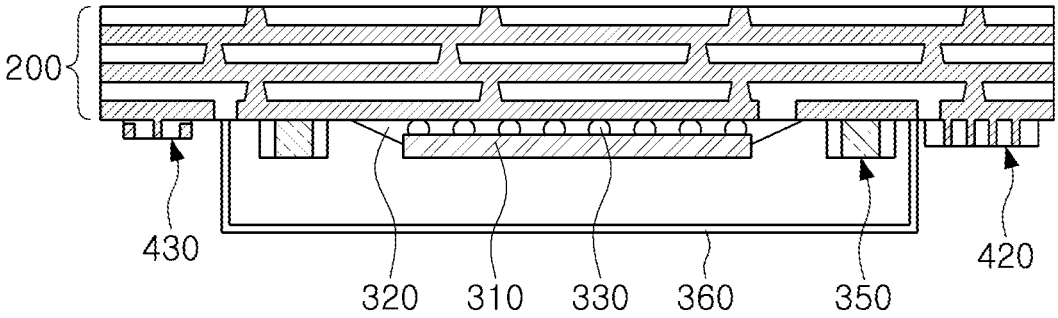

FIGS. 5A and 5B are side views of a connection member on which a ground plane is stacked, included in an antenna device, and a lower structure of the connection member according to an example embodiment.

Referring to FIG. 5A, an antenna apparatus in the example may include at least some of a connection member 200, an IC 310, an adhesive member 320, an electrical interconnect structure 330, an encapsulant 340, a passive component 350, and a sub-substrate 410.

The connection member 200 may have a structure in which the plurality of ground planes described in the aforementioned example examples may be stacked.

The IC 310 may be the same as the IC described in the aforementioned examples, and may be disposed below the connection member 200. The IC 310 may be connected to a wiring line of the connection member 200 and may transmit an RF signal to and receive an RF signal from the connection member 200. The IC 310 may also be electrically connected to a ground plane and may be provided with a ground. For example, the IC 310 may perform at least some of operations of frequency conversion, amplification, filtering, phase control, and power generation and may generate a converted signal.

The adhesive member 320 may attach the IC 310 to the connection member 200.

The electrical interconnect structure 330 may electrically connect the IC 310 to the connection member 200. For example, the electrical interconnect structure 330 may have a structure such as that of a solder ball, a pin, a land, and a pad. The electrical interconnect structure 330 may have a melting point lower than that of a wiring line and a ground plane of the connection member 200 such that the electrical interconnect structure 330 may electrically connect the IC 310 to the connection member 200 through a required process using the low melting point.

The encapsulant 340 may encapsulate at least a portion of the IC 310, and may improve heat dissipation performance and protection performance against impacts. For example, the encapsulant 340 may be implemented by a photoimageable encapsulant (PIE), an Ajinomoto build-up film (ABF), an epoxy molding compound (EMC), or the like.

The passive component 350 may be disposed on a lower surface of the connection member 200, and may be electrically connected to a wiring line and/or a ground plane of the connection member 200 through the electrical interconnect structure 330.

The sub-substrate 410 may be disposed below the connection member 200, and may be electrically connected to the connection member 200 to receive an intermediate frequency (IF) signal or a baseband signal from an external entity and to transmit the signal to the IC 310, or to receive an IF signal or a baseband signal from the IC 310 and to transmit the signal to an external entity. A frequency of an RF signal (e.g., 24 GHz, 28 GHz, 36 GHz, 39 GHz, 60 GHz) may be higher than a frequency of an IF signal (e.g., 2 GHz, 5 GHz, 10 GHz, or the like).

For example, the sub-substrate 410 may transmit an IF signal or baseband signal to the IC 310 or may receive an IF signal or baseband signal from the IC 310 through a wiring line included in an IC ground plane. As a first ground plane of the connection member 200 is disposed between the IC ground plane and a wiring line, an IF signal or a baseband signal and an RF signal may be electrically isolated from each other in an antenna module.

Referring to FIG. 5B, the antenna apparatus in the example may include at least some of a shielding member 360, a connector 420, and a chip antenna 430.

The shielding member 360 may be disposed below the connection member 200 and may enclose the IC 310 along with the connection member 200. For example, the shielding member 360 may cover or conformally shield the IC 310 and the passive component 350 together, or may separately cover or compartment-shield the IC 310 and the passive component 350. For example, the shielding member 360 may have a hexahedral shape in which one surface is open, and may have an accommodation space having a hexahedral form by being combined with the connection member 200. The shielding member 360 may be implemented by a material having relatively high conductivity such as copper such that the shielding member 360 may have a relatively short skin depth, and the shielding member 360 may be electrically connected to a ground plane of the connection member 200. Accordingly, the shielding member 360 may reduce electromagnetic noise which the IC 310 and the passive component 350 may receive.

The connector 420 may have a connection structure of a cable (e.g., a coaxial cable or a flexible PCB), may be electrically connected to the IC ground plane of the connection member 200, and may work similarly to the above-described sub-substrate. Accordingly, the connector 420 may be provided with an IF signal, a baseband signal, and/or power from a cable, or may provide an IF signal and/or a baseband signal to a cable.

The chip antenna 430 may transmit and/or receive an RF signal in addition to the antenna apparatus. For example, the chip antenna 430 may include a dielectric block having a dielectric constant higher than that of an insulating layer, and a plurality of electrodes disposed on both surfaces of the dielectric block. One of the plurality of electrodes may be electrically connected to a wiring line of the connection member 200, and the other one of the plurality of electrodes may be electrically connected to a ground plane of the connection member 200.

Figure 6A:
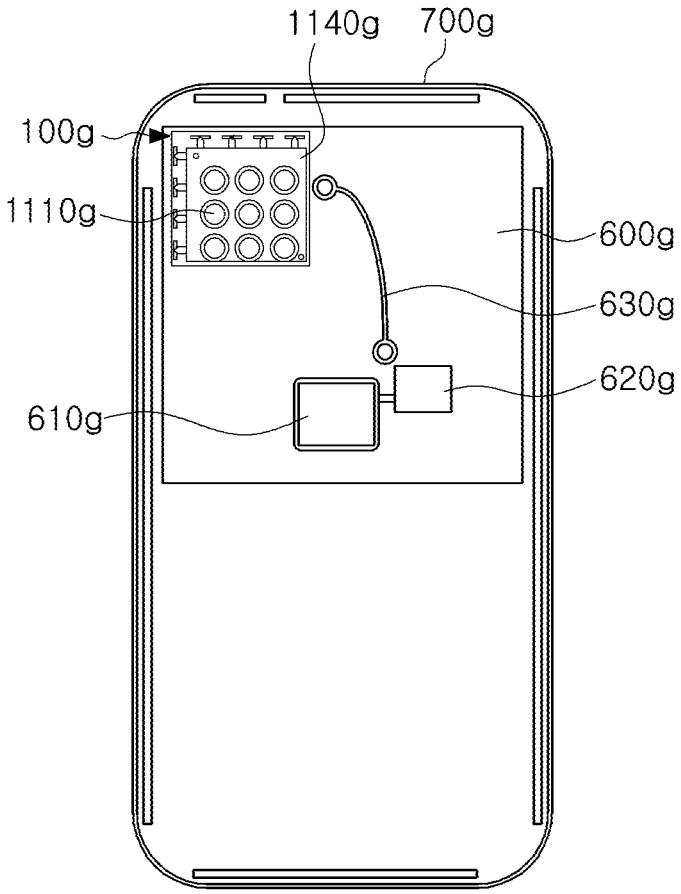
FIGS. 6A and 6B are plan views of an arrangement of an antenna apparatus in an electronic device according to an example.
Figure 6B:
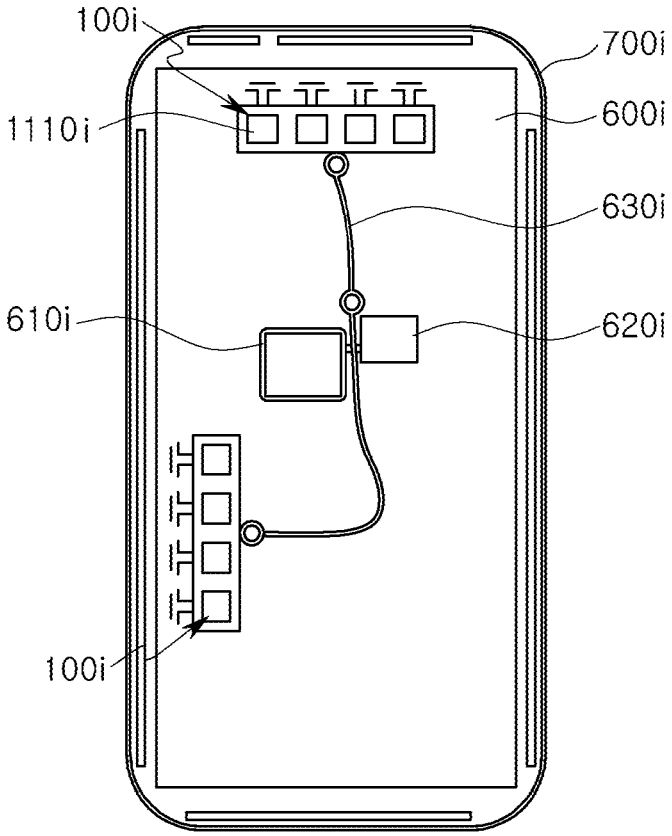

FIGS. 6A and 6B are plan diagrams illustrating an arrangement of an antenna apparatus in an electronic device according to an example.

Referring to FIG. 6A, an antenna apparatus 100*g* including a patch antenna pattern 1110*g* and a dielectric layer 1140*g* may be disposed adjacent to a side surface boundary of an electronic device 700*g* on a set substrate 600*g* of the electronic device 700*g*.

The electronic device 700*g* may be implemented by a smartphone, a personal digital assistant, a digital video camera, a digital still camera, a network system, a computer, a monitor, a tablet PC, a laptop PC, a netbook PC, a television, a video game, a smart watch, an automotive component, or the like, but an example of the electronic device 700*g* is not limited thereto.

A communication module 610*g* and a baseband circuit 620*g* may further be disposed on the set substrate 600*g*. The antenna module may be electrically connected to the communication module 610*g* and/or the baseband circuit 620*g* through a coaxial cable 630*g*.

The communication module 610*g* may include at least some of a memory chip such as a volatile memory (e.g., a DRAM), a non-volatile memory (e.g., a ROM), a flash memory, or the like; an application processor chip such as a central processor (e.g., a CPU), a graphics processor (e.g., a GPU), a digital signal processor, a cryptographic processor, a microprocessor, a microcontroller, or the like; and a logic chip such as an analog-to-digital converter, an application-specific integrated circuit (ASIC), or the like.

The baseband circuit 620*g* may generate a base signal by performing analog-to-digital conversion, and amplification, filtering, and frequency conversion on an analog signal. A base signal input to and output from the baseband circuit 620*g* may be transferred to the antenna module through a cable.

For example, the base signal may be transferred to an IC through an electrical interconnect structure, a cover via, and a wiring line. The IC may convert the base signal into an RF signal of millimeter wave (mmWave) band.

Referring to FIG. 6B, a plurality of antenna apparatuses 100*i* each including a patch antenna pattern 1110*i* may be disposed adjacent to a center of an edge of a polygonal electronic device 700*i* on a set substrate 600*i* of the electronic device 700*i*, and a communication module 610*i* and a baseband circuit 620*i* may further be disposed on the set substrate 600*i*. The plurality antenna apparatuses and the antenna modules may be electrically connected to the communication module 610*i* and/or baseband circuit 620*i* through a coaxial cable 630*i*.

The pattern, the via, the line, and the plane described in the aforementioned example embodiments may include a metal material (e.g., a conductive material such as copper (Cu), aluminum (Al), silver (Ag), tin (Sn), gold (Au), nickel (Ni), lead (Pb), titanium (Ti), or alloys thereof), and may be formed by a plating method such as a chemical vapor deposition (CVD) method, a physical vapor deposition (PVD) method, a sputtering method, a subtractive method, an additive method, a semi-additive process (SAP), a modified semi-additive process (MSAP), or the like, but examples of the material and the method are not limited thereto.

The dielectric layer in the example embodiments may be implemented by a material such as FR4, a liquid crystal polymer (LCP), low temperature co-fired ceramic (LTCC), a thermosetting resin such as an epoxy resin, a thermoplastic resin such as a polyimide resin, a resin in which the above-described resin is impregnated in a core material, such as a glass fiber (or a glass cloth or a glass fabric), together with an inorganic filler, such as prepreg, a Ajinomoto build-up film (ABF), FR-4, bismaleimide triazine (BT), a photoimagable dielectric (PID) resin, a general copper clad laminate (CCL), glass or a ceramic-based insulating material, or the like.

The RF signal described in the example embodiments may include protocols such as wireless fidelity (Wi-Fi) (Institute of Electrical And Electronics Engineers (IEEE) 802.11 family, or the like), worldwide interoperability for microwave access (WiMAX) (IEEE 802.16 family, or the like), IEEE 802.20, long term evolution (LTE), evolution data only (Ev-DO), high speed packet access +(HSPA+), high speed downlink packet access +(HSDPA+), high speed uplink packet access +(HSUPA+), enhanced data GSM environment (EDGE), global system for mobile communications (GSM), global positioning system (GPS), general packet radio service (GPRS), code division multiple access (CDMA), time division multiple access (TDMA), digital enhanced cordless telecommunications (DECT), Bluetooth, 3G, 4G, and 5G protocols, and any other wireless and wired protocols designated after the above-mentioned protocols, but an example is not limited thereto.

According to the aforementioned examples, the antenna apparatus may have improved antenna performances (e.g., a gain, a bandwidth, directivity, and the like), and/or may be easily miniaturized.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed to have a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna apparatus, comprising:

a ground plane;

a first patch antenna pattern disposed above and spaced apart from a first surface of the ground plane;

a second patch antenna pattern disposed above and spaced apart from the first surface of the ground plane, and spaced apart from the first patch antenna pattern;

a first feed via configured to provide a first feed path of the first patch antenna pattern through a first point of the first patch antenna pattern, and disposed adjacent to an edge of the first patch antenna pattern in a direction in which the first point is spaced apart from the second patch antenna pattern;

a second feed via configured to provide a second feed path of the second patch antenna pattern through a second point of the second patch antenna pattern, and disposed adjacent to an edge of the second patch antenna pattern in a direction in which the second point is spaced apart from the first patch antenna pattern; and a first coupling pattern disposed between the first patch antenna pattern and the second patch antenna pattern, and spaced apart from the first patch antenna pattern and the second patch antenna pattern, and configured to define a first internal space of the first coupling pattern that is exposed towards the first patch antenna pattern.

2. The antenna apparatus of claim 1, further comprising:

a second coupling pattern disposed between the second patch antenna pattern and the first coupling pattern, and spaced apart from the first coupling pattern, and configured to define a second internal space of the second coupling pattern that is exposed towards the second patch antenna pattern.

3. The antenna apparatus of claim 2, further comprising:

a first ground via electrically connecting the first coupling pattern to the ground plane; and a second ground via electrically connecting the second coupling pattern to the ground plane.

4. The antenna apparatus of claim 3, wherein the first ground via is electrically connected to a point of the first coupling pattern adjacent to the second coupling pattern, and wherein the second ground via is electrically connected to a point of the second coupling pattern adjacent to the first coupling pattern.

5. The antenna apparatus of claim 2, wherein a gap between the first coupling pattern and the second coupling pattern is smaller than a gap between the first coupling pattern and the first patch antenna pattern.

6. The antenna apparatus of claim 5, wherein a length of the first coupling pattern along a direction perpendicular to a direction in which the first and second coupling patterns oppose each other is larger than a width of the first coupling pattern.

7. The antenna apparatus of claim 2, further comprising:

an upper coupling pattern disposed above and spaced apart from the first coupling pattern and the second coupling pattern such that the first coupling pattern and the second coupling pattern are disposed between the ground plane and the upper coupling pattern along a direction perpendicular to the first surface of the ground plane, and configured to overlap the first coupling pattern and the second coupling pattern in the direction perpendicular to the first surface of the ground plane.

8. The antenna apparatus of claim 7, wherein the upper coupling pattern is configured to overlap a gap between the first coupling pattern and the second coupling pattern, the first internal space of the first coupling pattern, and the second internal space of the second coupling pattern in a direction perpendicular to the first surface of the ground plane.

9. The antenna apparatus of claim 7, further comprising:

a first upper patch pattern disposed above and spaced apart from the first patch antenna pattern;

a second upper patch pattern disposed above and spaced apart from the second patch antenna pattern; and a supplementary patch pattern spaced apart from the upper coupling pattern along a direction different from at least one direction in which the supplementary patch pattern spaced is apart from the first upper patch pattern and the second upper patch pattern.

10. The antenna apparatus of claim 9, wherein the supplementary patch pattern includes a plurality of supplementary patch patterns spaced apart from each other, and each having a size smaller than a size of the upper coupling pattern.

11. The antenna apparatus of claim 1, further comprising:

a first upper patch pattern disposed above and spaced apart from the first patch antenna pattern;

a second upper patch pattern disposed above and spaced apart from the second patch antenna pattern; and an upper coupling pattern disposed above and spaced apart from the first coupling pattern, and configured to overlap the first coupling pattern in a direction perpendicular to the first surface of the ground plane.

12. The antenna apparatus of claim 2, further comprising:

a third patch antenna pattern disposed above and spaced apart from the first surface of the ground plane, and spaced apart from the first patch antenna pattern and the second patch antenna pattern;

a fourth patch antenna pattern disposed above and spaced apart from the first surface of the ground plane and spaced apart from the first patch antenna pattern, the second patch antenna pattern, and the third patch antenna pattern;

a third coupling pattern disposed between the first patch antenna pattern and the third patch antenna pattern, and spaced apart from the first patch antenna pattern and the third patch antenna pattern, and configured to define a third internal space of the third coupling pattern that is exposed towards the first patch antenna pattern; and a fourth coupling pattern disposed between the second patch antenna pattern and the fourth patch antenna pattern, and spaced apart from the second patch antenna pattern and the fourth patch antenna pattern, and configured to define a fourth internal of the fourth coupling pattern space that is exposed towards the second patch antenna pattern.

13. The antenna apparatus of claim 12, further comprising:

a fifth coupling pattern disposed between the third patch antenna pattern and the fourth patch antenna pattern, and configured to define a fifth internal space of the fifth coupling pattern that is exposed towards the third patch antenna pattern;

a sixth coupling pattern spaced disposed between the third patch antenna pattern and the third coupling pattern, and spaced apart from the third coupling pattern, and configured to define a sixth internal space of the sixth coupling pattern that is exposed towards the third patch antenna pattern;

a seventh coupling pattern disposed between the fourth patch antenna pattern and the fourth coupling pattern, and spaced apart from the fourth coupling pattern, and configured to define a seventh internal space of the seventh coupling pattern that is exposed towards the fourth patch antenna pattern; and an eighth coupling pattern disposed between the fourth patch antenna pattern and the fifth coupling pattern, and spaced apart from the fifth coupling pattern, and configured to define an eighth internal space of the eighth coupling pattern that is exposed towards the fourth patch antenna pattern.

14. The antenna apparatus of claim 12, further comprising:

a third feed via configured to provide a third feed path of the first patch antenna pattern through a third point of the first patch antenna pattern, and disposed adjacent to an edge of the first patch antenna pattern in a direction in which the third point is spaced apart from the third patch antenna pattern;

a fourth feed via configured to provide a fourth feed path of the second patch antenna pattern through a fourth point of the second patch antenna pattern, and disposed adjacent to an edge of the second patch antenna pattern in a direction in which the fourth point is spaced apart from the fourth patch antenna pattern;

a fifth feed via configured to provide a fifth feed path of the third patch antenna pattern through a fifth point of the third patch antenna pattern, and disposed adjacent to an edge of the third patch antenna pattern in a direction in which the fifth point is spaced apart from the fourth patch antenna pattern;

a sixth feed via configured to provide a sixth feed path of the third patch antenna pattern through a sixth point of the third patch antenna pattern, and disposed adjacent to an edge of the third patch antenna pattern in a direction in which the sixth point is spaced apart from the first patch antenna pattern;

a seventh feed via configured to provide a seventh feed path of the fourth patch antenna pattern through a seventh point of the fourth patch antenna pattern, and disposed adjacent to an edge of the fourth patch antenna pattern in a direction in which the seventh point is spaced apart from the second patch antenna pattern; and an eighth feed via configured to provide an eighth feed path of the fourth patch antenna pattern through an eighth point of the fourth patch antenna pattern, and disposed adjacent to an edge of the fourth patch antenna pattern in a direction in which the eighth point is spaced apart from the third patch antenna pattern.

15. The antenna apparatus of claim 12, further comprising:

a fifth coupling pattern disposed between the third patch antenna pattern and fourth patch antenna patterns, and configured to define a fifth internal space exposed towards the third patch antenna pattern; and a plurality of upper coupling patterns disposed above and spaced apart from the first coupling pattern, the second coupling pattern, the third coupling pattern, the fourth coupling pattern, and the fifth coupling pattern such that the first coupling pattern, the second coupling pattern, the third coupling pattern, the fourth coupling pattern, and the fifth coupling pattern are disposed between the ground plane and the upper coupling patterns along a direction perpendicular to the first surface of the ground plane, and configured to overlap the first coupling pattern, the second coupling pattern, the third coupling pattern, the fourth coupling pattern, and the fifth coupling pattern in the direction perpendicular to the first surface of the ground plane.

16. The antenna apparatus of claim 15, further comprising:

a plurality of supplementary patch patterns surrounded by the upper coupling patterns, spaced apart from each other, and each having a size smaller than a size of each of the upper coupling patterns.

17. The antenna apparatus of claim 15, further comprising:

a supplementary patch pattern surrounded by the upper coupling patterns, wherein a space overlapping the supplementary patch pattern in the direction perpendicular to the first surface of the ground plane and disposed on a same level as the first coupling pattern, the second coupling pattern, the third coupling pattern, the fourth coupling pattern, and the fifth coupling pattern is formed of a non-conductive material or air.

* * * * *